US010865791B2

(12) United States Patent
Kim et al.

(10) Patent No.: US 10,865,791 B2
(45) Date of Patent: Dec. 15, 2020

(54) SCROLL COMPRESSOR HAVING A CAPACITY VARIABLE DEVICE

(71) Applicant: LG ELECTRONICS INC., Seoul (KR)

(72) Inventors: Minjae Kim, Seoul (KR); Jaeheon Jeong, Seoul (KR); Jinhak Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 320 days.

(21) Appl. No.: 15/960,266

(22) Filed: Apr. 23, 2018

(65) Prior Publication Data

US 2019/0219055 A1 Jul. 18, 2019

(30) Foreign Application Priority Data

Jan. 16, 2018 (KR) ..... 10-2018-0005726

(51) Int. Cl.
*F03C 2/00* (2006.01)
*F03C 4/00* (2006.01)
(Continued)

(52) U.S. Cl.
CPC ..... *F04C 28/265* (2013.01); *F01C 19/005* (2013.01); *F04C 18/0215* (2013.01);
(Continued)

(58) Field of Classification Search
CPC ..... F04C 18/0215; F04C 18/0261; F04C 18/0292; F04C 23/008; F04C 27/005;
(Continued)

(56) References Cited

U.S. PATENT DOCUMENTS 5,059,098 A * 10/1991 Suzuki ..... F04C 18/0215 417/310
5,613,841 A * 3/1997 Bass ..... F04C 18/0215 417/310
(Continued)

FOREIGN PATENT DOCUMENTS

JP 2012-502231 A 1/2012
JP 2013-170603 A 9/2013
(Continued)

*Primary Examiner* — Theresa Trieu
(74) *Attorney, Agent, or Firm* — Dentons US LLP

(57) ABSTRACT

A scroll compressor including a bypass passage to guide refrigerant from a compression chamber to a low pressure portion of the compressor; a valve located in a valve receiving portion and slideable between first and second positions in which the bypass passage is respectively closed and opened; a ring-shaped seal between an outer peripheral surface of the valve and an inner peripheral surface of the valve receiving portion; and a seal groove formed in at least one of the outer peripheral surface of the valve and the inner peripheral surface of the valve receiving portion, the seal being inserted into the seal groove, wherein at least one of the outer peripheral surface of the valve, the inner peripheral surface of the valve receiving portion, and the inner peripheral surface of the seal groove has an inclined surface that is inclined in the opening/closing direction of the valve.

20 Claims, 18 Drawing Sheets

(51) Int. Cl.

| | |
|---|---|
| ***F04C 18/00*** | (2006.01) |
| ***F04C 28/26*** | (2006.01) |
| ***F04C 27/00*** | (2006.01) |
| ***F04C 18/02*** | (2006.01) |
| ***F01C 19/00*** | (2006.01) |
| *F04C 23/00* | (2006.01) |
| *F01C 20/26* | (2006.01) |

(52) U.S. Cl.
CPC ..... *F04C 18/0261* (2013.01); *F04C 18/0292* (2013.01); *F04C 27/005* (2013.01); *F04C 27/008* (2013.01); *F01C 20/26* (2013.01); *F04C 23/008* (2013.01); *F04C 28/26* (2013.01)

(58) Field of Classification Search
CPC ..... F04C 27/008; F04C 28/16; F04C 28/18; F04C 28/24; F04C 28/26; F04C 28/265; F01C 19/005; F01C 20/24; F01C 20/26
See application file for complete search history.

(56) References Cited

U.S. PATENT DOCUMENTS

| | | | | |
|---|---|---|---|---|
| 6,412,293 | B1 * | 7/2002 | Pham | F04C 28/14 62/228.3 |
| 8,313,318 | B2 | 11/2012 | Stover et al. | |
| 8,568,118 | B2 | 10/2013 | Stover et al. | |
| 10,316,843 | B2 * | 6/2019 | Jin | F04C 28/26 418/55.5 |
| 10,428,818 | B2 * | 10/2019 | Jin | F04C 28/26 418/55.5 |
| 10,428,819 | B2 * | 10/2019 | Jin | F04C 28/26 418/55.5 |
| 2011/0058972 | A1 * | 3/2011 | Patel | F04C 18/0215 418/55.2 |
| 2015/0345493 | A1 * | 12/2015 | Lochner | F04C 18/0215 418/55.5 |

FOREIGN PATENT DOCUMENTS

| | | | |
|---|---|---|---|
| KR | 10-2016-0000300 | A | 1/2016 |
| KR | 10-1800261 | B1 | 11/2017 |

* cited by examiner

SCROLL COMPRESSOR HAVING A CAPACITY VARIABLE DEVICE

CROSS-REFERENCE TO RELATED APPLICATION

The present disclosure claims the benefit of priority to Korean Application No. 10-2018-0005726, filed on Jan. 16, 2018, the contents of which is incorporated by reference herein in its entirety.

BACKGROUND

1. Field

The present disclosure relates to a scroll compressor, and more particularly to a scroll compressor having a capacity variable device.

2. Description of the Conventional Art

In a scroll compressor, a non-orbiting scroll is provided in an inner space of a casing, and an orbiting scroll is engaged with the non-orbiting scroll to perform an orbiting motion. The cross compressor also includes a pair of compression chambers composed of a suction chamber, an intermediate pressure chamber and a discharge chamber being defined between a non-orbiting wrap of the non-orbiting scroll and an orbiting wrap of the orbiting scroll.

The scroll compressor is commonly used for compressing refrigerant in an air conditioner or the like, because it can obtain a relatively high compression ratio as compared with other types of compressors, and it can also obtain a stable torque due to smooth connections of suction, compression and discharge strokes of the refrigerant.

The above-described scroll compressor can have a variable compression capacity depending upon the demand of a refrigerating machine to which the compressor is applied, like other compressors. For example, as disclosed in U.S. Pat. Nos. 8,568,118 and 8,313,318 (collectively referred to as "Conventional Art"), respective piston valves 398 and 156 are configured to open and close bypass holes 370, 372, 374 and 148, 150 while being axially moved in respective valve holes.

The Conventional Art selectively performs the power operation or the saving operation while controlling the movement of the respective piston valves to selectively open and close the respective bypass holes. In the Conventional Art, a rubber type O-ring or Teflon type sealing structure is provided on the outer peripheral surface of each piston valve to prevent the refrigerant from leaking between the piston valve and the valve hole during power operation.

When the Teflon type sealing structure is applied to the conventional scroll compressor described above, as opposed to the rubber-type O-ring sealing structure, it is advantageous in terms of operability of the piston valve, but the Teflon type seal member is more expensive than the rubber-type O-ring, which leads to increased manufacturing costs of the compressor.

Meanwhile, when the lower cost rubber-type O-ring is applied, it is advantageous in terms of the cost, but is disadvantageous in terms of operability of the piston valve because it is difficult to perform the processing that can satisfy a suitable tolerance range in consideration of the characteristics of the O-ring. More particularly, when the amount of thickness reduction (squeeze) of the O-ring is small, that is defined as a gap between a seal receiving groove into which the O-ring is inserted and a sliding surface of the O-ring, the inner peripheral surface of the O-ring and the outer peripheral surface of the piston valve can not be closely attached to each other, as a result of which refrigerant leakage may occur and energy efficiency may be reduced. On the other hand, when the squeeze of the O-ring is large, the inner peripheral surface of the O-ring and the outer peripheral surface of the piston valve are closely attached to each other, and thus the opening operation of the piston valve is delayed, causing a passage resistance against the bypass refrigerant, as a result of which a cooling reduction ratio may be lowered and energy saving effects may be reduced.

SUMMARY

The present invention has been made in order to solve at least the above problems associated with the conventional technology.

An object of the present disclosure is to provide a scroll compressor which can reduce material costs of components applied to a capacity variable device.

Another object of the present disclosure is to provide a scroll compressor which can restrict refrigerant leakage or passage resistance by changing a squeeze of a seal member in response to the operation mode.

A further object of the present disclosure is to provide a scroll compressor which can improve energy efficiency and energy saving effects while reducing manufacturing costs of a structure of a capacity variable device.

To achieve the above objects, there is provided a scroll compressor, including a seal member with elasticity provided between an outer peripheral surface of a piston valve and an inner peripheral surface of a valve receiving portion into which the piston valve is slidably inserted and a seal receiving groove into which the seal member is inserted, wherein the seal member has a variable squeeze along the moving direction of the piston valve.

The squeeze of the seal member may increase when the piston valve moves in a closing direction and may decrease when the piston valve moves in an opening direction.

An inclined surface may be formed on at least one of the inner peripheral surface of the valve receiving portion or the outer peripheral surface of the seal member or the main surface of the seal receiving portion along the moving direction of the piston valve.

To achieve the above objects, there is also provided a scroll compressor, including: a casing having an inner space divided into a low pressure portion and a high pressure portion; a first scroll provided in the inner space of the casing to perform an orbiting motion; a second scroll for defining a compression chamber with the first scroll; a bypass passage for guiding some of the refrigerant compressed in the compression chamber to be bypassed to the lower pressure portion of the casing; a valve member slidably provided between a first position in which the bypass passage is closed and a second position in which the bypass passage is open, to selectively open and close the bypass passage; a valve receiving portion for receiving the valve member so that the valve member slides between the first position and the second position; and at least one seal member provided between the outer peripheral surface of the valve member and the inner peripheral surface of the valve receiving portion; and a seal receiving groove provided in at least one of the outer peripheral surface of the valve member and the inner peripheral surface of the valve receiving portion, the seal member being inserted into the seal receiving groove, wherein at least one of the outer peripheral surface of the valve member, an inner peripheral surface of the valve receiving portion and the inner peripheral surface of the seal receiving portion is provided with an inclined surface that is inclined in the opening/closing direction of the valve member.

The seal receiving groove may be formed in the inner peripheral surface of the valve receiving portion, the inclined surface may be formed on the outer peripheral surface of the valve member, and the outer diameter of the inclined surface may decrease toward the bypass passage.

The seal receiving groove and the inclined surface may be formed on the outer peripheral surface of the valve member, respectively, and the outer diameter of the inclined surface may decrease toward the bypass passage.

The seal receiving groove may be formed in the outer peripheral surface of the valve member, the inclined surface may be formed on the inner peripheral surface of the valve receiving portion, and the inner diameter of the inclined surface may increase away from the bypass passage.

The seal receiving groove may be formed in the inner peripheral surface of the valve receiving portion, the inclined surface may be formed on the inner peripheral surface of the seal receiving portion, and the inner diameter of the inclined surface may decrease toward the bypass passage.

The seal receiving groove may be formed in the outer peripheral surface of the valve member, the inclined surface may be formed on the inner peripheral surface of the seal receiving portion, and the inner diameter of the inclined surface may decrease toward the bypass passage.

The minimum diameter of the inclined surface may be equal to or smaller than the inner diameter or the outer diameter of the seal member corresponding to the inclined surface, and the maximum diameter of the inclined surface may be larger than the inner diameter or the outer diameter of the seal member corresponding to the inclined surface.

The length of the seal receiving groove in the opening/closing direction of the valve member may be larger than the diameter of the seal member such that the seal member is movable in the seal receiving groove.

To achieve the above objects, there is also provided a scroll compressor, including: a casing having an inner space divided into a low pressure portion and a high pressure portion; a first scroll provided in the inner space of the casing to perform an orbiting motion; a second scroll for defining a compression chamber with the first scroll; a back pressure chamber assembly fixed to the second scroll in the inner space of the casing to define a back pressure chamber; a bypass passage for guiding some of the refrigerant compressed in the compression chamber to the lower pressure portion of the casing; a first valve assembly for selectively opening and closing the bypass passage; and a second valve assembly for generating a pressure difference in the first valve assembly to control the opening/closing operation of the first valve assembly, wherein the valve assembly includes a valve member slidably moved in the valve receiving portion to open and close the bypass passage, a seal member which is composed of an O-ring is provided between the valve receiving portion and the outer peripheral surface of the valve member, and a distance between a seal receiving groove into which the seal member is inserted and a sealing surface which the seal member slidably contacts is variable along the moving direction of the valve member.

The distance may be determined such that the squeeze of the seal member increases when the valve member moves to a position in which the bypass passage is closed and decreases when the valve member moves to a position in which the bypass passage is open.

The valve member may be configured such that the sectional area of the opening/closing surface that opens and closes the bypass passage is smaller than the sectional area of the back pressure surface that is opposite to the opening/closing surface.

The valve receiving portion may be formed such that the sectional area of the part close to the bypass passage is smaller than the sectional area of the part distant from the bypass passage.

The valve receiving portion and the valve member may have constant sectional areas, respectively, along the opening/closing direction of the valve member, and the seal receiving groove may have a variable depth along the longitudinal direction of the valve member.

The bypass passage may include: at least one bypass hole formed in the compression chamber in a penetrating manner and selectively opened and closed by the bypass valve; an intermediate pressure communication groove formed in at least any one of the second scroll and the back pressure chamber assembly to communicate with the bypass hole and receive the bypass valve; and a discharge hole having one end connected to the intermediate pressure communication groove and the other end formed in the outer peripheral surface of the second scroll or the outer peripheral surface of the back pressure chamber assembly in a penetrating manner and opened and closed by the valve member.

The bypass passage may include: at least one bypass hole formed in the compression chamber in a penetrating manner and selectively opened and closed by the valve member; and a plurality of discharge grooves having one end selectively communicating with the bypass hole by the valve member and the other end extending to the outer peripheral surface of the second scroll or the back pressure chamber assembly, so that the bypass hole communicates with the low pressure portion of the casing.

To achieve the above objects, there is also provided a scroll compressor, including: a casing having an inner space divided into a low pressure portion and a high pressure portion; a first scroll provided in the inner space of the casing to perform an orbiting motion; a second scroll for defining a compression chamber with the first scroll; a back pressure chamber assembly fixed to the second scroll in the inner space of the casing to define a back pressure chamber; a bypass passage for guiding some of the refrigerant compressed in the compression chamber to the lower pressure portion of the casing; a first valve assembly for selectively opening and closing the bypass passage; and a second valve assembly for generating a pressure difference in the first valve assembly to control the opening/closing operation of the first valve assembly, wherein the first valve assembly includes a valve member slidably moved in the valve receiving portion to open and close the bypass passage, a seal member which is composed of an O-ring is provided on either the valve receiving portion or the valve member to seal the gap between the valve receiving portion and the outer peripheral surface of the valve member, an inclined surface is provided on either the valve receiving portion or the valve member, the minimum diameter of the inclined surface is equal to or smaller than the inner diameter or the outer diameter of the seal member corresponding to the inclined surface, and the maximum diameter of the inclined surface is larger than the inner diameter or the outer diameter of the seal member corresponding to the inclined surface.

The inclined surface may be formed on either the outer peripheral surface of the valve member or the inner peripheral surface of the valve receiving portion.

A seal receiving groove into which the seal member is inserted may be formed in either the valve receiving portion or the valve member, and the inclined surface may be formed on the outer peripheral surface of the seal receiving groove.

The inclined surface may be formed such that the squeeze of the seal member increases when the valve member moves to a direction in which the bypass passage is closed and decreases when the valve member moves to a direction in which the bypass passage is open.

The seal receiving groove may be formed in an overlapping range with the inclined surface.

The scroll compressor according to the present invention makes use of the change in the squeeze of the seal member to obtain a different sealing force according to the operation mode, which makes it possible to obtain the sealing force required for the variable capacity even with the seal member which is composed of a conventional O-ring, which results in low material costs for the parts.

The scroll compressor according to the present invention changes the squeeze of the seal member in response to the operation mode, which makes it possible to increase the sealing force and restrict refrigerant leakage during the power operation and to reduce the frictional force and rapidly open the valve in the saving operation.

The scroll compressor according to the present invention employs the seal member which is composed of the O-ring and allows it to be closely attached only when necessary according to the position of the valve, which makes it possible to not only enhance the workability of the seal member or the valve but also expect high energy efficiency and energy saving effects.

BRIEF DESCRIPTION OF THE DRAWINGS

The accompanying drawings, which are included to provide a further understanding of the invention and are incorporated in and constitute a part of this specification, illustrate exemplary embodiments of the invention and together with the description serve to explain the principles of the invention.

In the drawings.

DETAILED DESCRIPTION OF THE PREFERRED EMBODIMENTS

Hereinafter, embodiments of a scroll compressor according to the present disclosure will be described in detail with reference to the accompanying drawings.

These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
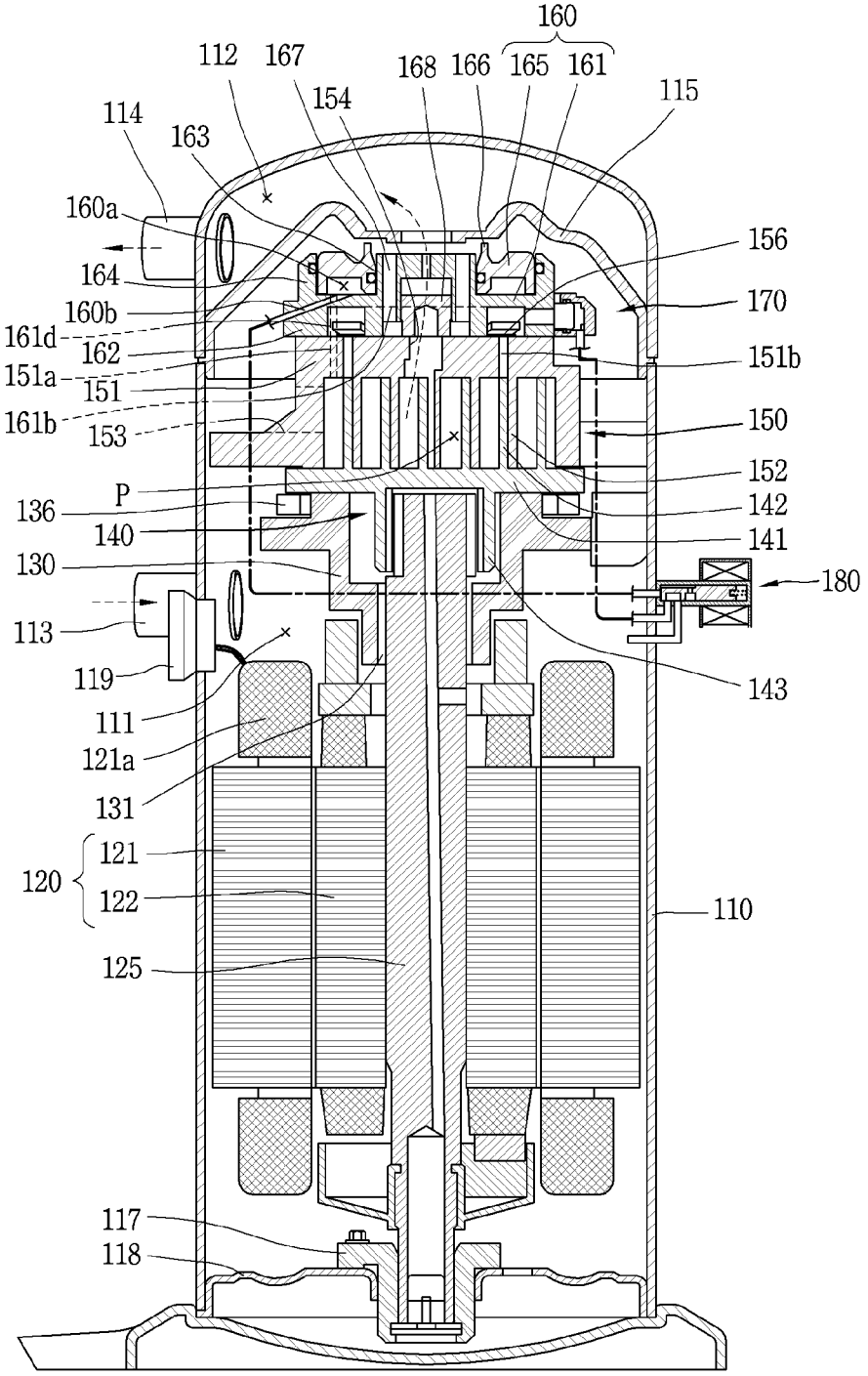
FIG. 1 is a sectional view showing a scroll compressor having a capacity variable device according to and embodiment of the present disclosure.

FIG. 1 is a vertical sectional view showing a scroll compressor having a capacity variable device according to an embodiment of the present disclosure.

As shown, a hermetic inner space of a casing 110 is divided into a low pressure portion 111, which is a suction space, and a high pressure portion 112, which is a discharge space by a high/low pressure separation plate 115.

High/low pressure separation plate 115 is provided on a non-orbiting scroll 150 (hereinafter, referred to as a "second scroll"). Low pressure portion 111 corresponds to a lower space that is below high/low pressure separation plate 115, while the high pressure portion 112 corresponds to an upper space that is above high/low pressure separation plate 115.

A suction pipe 113 communicating with the low pressure portion 111 and a discharge pipe 114 communicating with high pressure portion 112 may be fixed to casing 110, respectively, so that refrigerant can be suctioned into the inner space of the casing 110 or discharged out of the casing 110.

A drive motor 120 composed of a stator 121 and a rotor 122 may be provided in low pressure portion 111 of casing 110. Stator 121 may be fixed to the inner wall surface of casing 110 in a shrink fit-like manner, and a rotary shaft 125 may be inserted into and coupled to the center portion of the rotor 122. A coil 121*a* may be wound around the stator 121 and electrically connected to an external power source through a terminal 119 coupled to casing 110 in a penetrating manner.

The lower side of rotary shaft 125 may be rotatably supported by an auxiliary bearing 117 provided in the lower portion of casing 110. Auxiliary bearing 117 may be fixed by a lower frame 118 that is fixed to the inner surface of casing 110, for stably supporting rotary shaft 125. Lower frame 118 may be fixed to the inner wall surface of casing 110 by welding (or another well known method), and the bottom surface of casing 110 can be used as an oil storing space. The oil stored in the oil storing space may be transferred to the upper side by rotary shaft 125 and enter a driving portion and a compression chamber so as to facilitate lubrication.

The upper end of rotary shaft 125 may be rotatably supported by a main frame 130. Main frame 130 may be fixed to the inner wall surface of the casing 110 like lower frame 118, a main bearing portion 131 downwardly projects from the lower surface thereof, and rotary shaft 125 is inserted into main bearing portion 131. The inner wall surface of main bearing portion 131 may function as a bearing surface to support rotary shaft 125 so that it can more smoothly rotate with the aforementioned oil.

An orbiting scroll 140 (hereinafter, referred to as a "first scroll") is disposed on the upper surface of main frame 130. Second scroll 140 includes an orbiting-side end plate portion 141, which is generally shaped in a disc-like shape, and an orbiting wrap 142 disposed on one side surface of orbiting-side end plate portion 141 in a spiral-like manner. Orbiting wrap 142 forms a compression chamber P with a non-orbiting wrap 152 of the second scroll 150 (discussed in more detail below).

Orbiting-side end plate portion 141 is orbit-driven while being supported by the upper surface of main frame 130. An oldham ring 136 may be disposed between orbiting-side end plate portion 141 and main frame 130 to prevent the rotation of first scroll 140.

In turn, a boss portion 143 into which rotary shaft 125 is inserted may be formed on the lower surface of orbiting-side end plate portion 141. The rotary power of rotary shaft 125 through boss portion 143 may orbit-drive orbiting scroll 140.

Second scroll 150 engaged with first scroll 140 may be disposed on first scroll 140. For example, second scroll 150 may be movable in a vertical direction (e.g., upwardly) with respect to the first scroll 140. More specifically, for example, second scroll 150 may be supported on the upper surface of main frame 130 while a plurality of guide pins (not shown) fitted into main frame 130 are inserted into a plurality of guide holes (not shown) formed in the outer periphery of second scroll 150.

Meanwhile, second scroll 150 may be configured such that a disc-shaped upper surface of a body portion forms a non-orbiting-side end plate portion 151 and a non-orbiting wrap 152 engaged with the above-described orbiting wrap 142 is formed under non-orbiting-side end plate portion 151 in a spiral-like manner.

A suction port 153 through which refrigerant present in the low pressure portion 111 may be formed at the side surface of second scroll 150, and a discharge port 154 through which compressed refrigerant is discharged may be formed generally at the center portion of non-orbiting-side end plate portion 151.

As described above, orbiting wrap 142 and non-orbiting wrap 152 form a plurality of compression chambers P that orbit-move toward discharge port 154 with a reduced volume to compress refrigerant. Therefore, the compression chamber disposed adjacent to suction port 153 may have a reduced or minimum pressure, the compression chamber communicating with discharge port 154 may have a maximum pressure, and the compression chambers disposed there between may have an intermediate pressure having a value between the suction pressure of suction port 153 and the discharge pressure of discharge port 154. The intermediate pressure may be applied to a back pressure chamber 160*a* (discussed in more detail below) to press second scroll 150 against first scroll 140, so that a scroll-side back pressure hole 151*a* is formed in non-orbiting-side end plate portion 151, for communication with the back pressure chamber. Scroll-side back pressure hole 151*a* communicates with one of the intermediate pressure regions, and thus communicates with a plate-side back pressure hole 161*d* (discussed in more detail below).

A back pressure plate 161 composing part of a back pressure chamber assembly 160 may be attached to or fixed on the non-orbiting-side end plate portion 151. Back pressure plate 161 may have an annular shape and be provided with a support plate 162 that is brought into contact with non-orbiting-side end plate portion 151. Support plate 162 may have an annular plate shape with a center hole, and as described above, plate-side back pressure hole 161*d* communicating with the scroll-side back pressure hole 151*a* may be formed in the support plate 162 in a penetrating manner.

In turn, first and second annular walls 163 and 164 may be formed on upper surface of the support plate 162 so as to surround the inner and outer peripheral surfaces of support plate 162. The outer peripheral surface of first annular wall 163, the inner peripheral surface of second annular wall 164 and the upper surface of support plate 162 together may form the annular back pressure chamber 160*a*.

A floating plate 165 forming the upper surface of back pressure chamber 160*a* may be provided on the upper side of the back pressure chamber 160*a*. A sealing end 166 may be provided on the upper end of the inner space of floating plate 165. Sealing end 166 may upwardly project from the surface of floating plate 165, the inner diameter thereof formed so as to not conceal or block an intermediate discharge port 167. Sealing end 166 may be brought into the lower surface of the above-described high/low pressure separation plate 115 to allow discharged refrigerant to be discharged to high pressure portion 112 without leaking to low pressure portion 111.

A bypass valve 156 (second bypass valve) that opens and closes a discharge bypass hole (second bypass hole) may be provided for bypassing part of the compressed refrigerant from the compression chamber so as to substantially prevent or prevent over-compression. A filter 160*c* and a check valve 168 may be provide for preventing refrigerant discharged to the high pressure portion from flowing backward into the compression chamber.

The operation of the scroll compressor of the present embodiment is described below.

Rotary shaft 125 is rotated by applying power to stator 121. Then, first scroll 140 coupled to the upper end of rotary shaft 125 performs an orbiting motion with respect to second scroll 150, with the rotation of rotary shaft 125, and thus the plurality of compression chambers P formed between non-orbiting wrap 152 and orbiting wrap 142 move toward discharge port 154 to compress refrigerant.

If compression chamber P communicates with the scroll-side back pressure hole (not shown) before reaching discharge port 154, some refrigerant may be introduced into the plate-side back pressure hole (not shown) formed in support plate 162, and thus an intermediate pressure may be applied to back pressure chamber 160*a* that is formed by back pressure plate 161 and floating plate 165. As a result, back pressure plate 161 is subject to pressure against second scroll 150, while floating plate 165 is subject to pressure against high/low pressure separation plate 115.

Here, since back pressure plate 161 is coupled to second scroll 150 by a bolt (not limited thereto), the intermediate pressure in back pressure chamber 160*a* impacts second scroll 150. However, since second scroll 150 already brought into contact with first scroll 140 cannot move downwardly, floating plate 165 moves upwardly toward the high/low pressure separation plate 115. As sealing end 166 contacts the lower end of high/low pressure separation plate 115, floating plate 165 prevents refrigerant from being leaked from the discharge space, i.e., high pressure portion 112 to the lower pressure portion 111, which is the suction space,. Moreover, the pressure in back pressure chamber 160*a* pushes second scroll 150 against first scroll 140, which prevents or substantially prevents leakage between first scroll 140 and second scroll 150.

Figure 2:
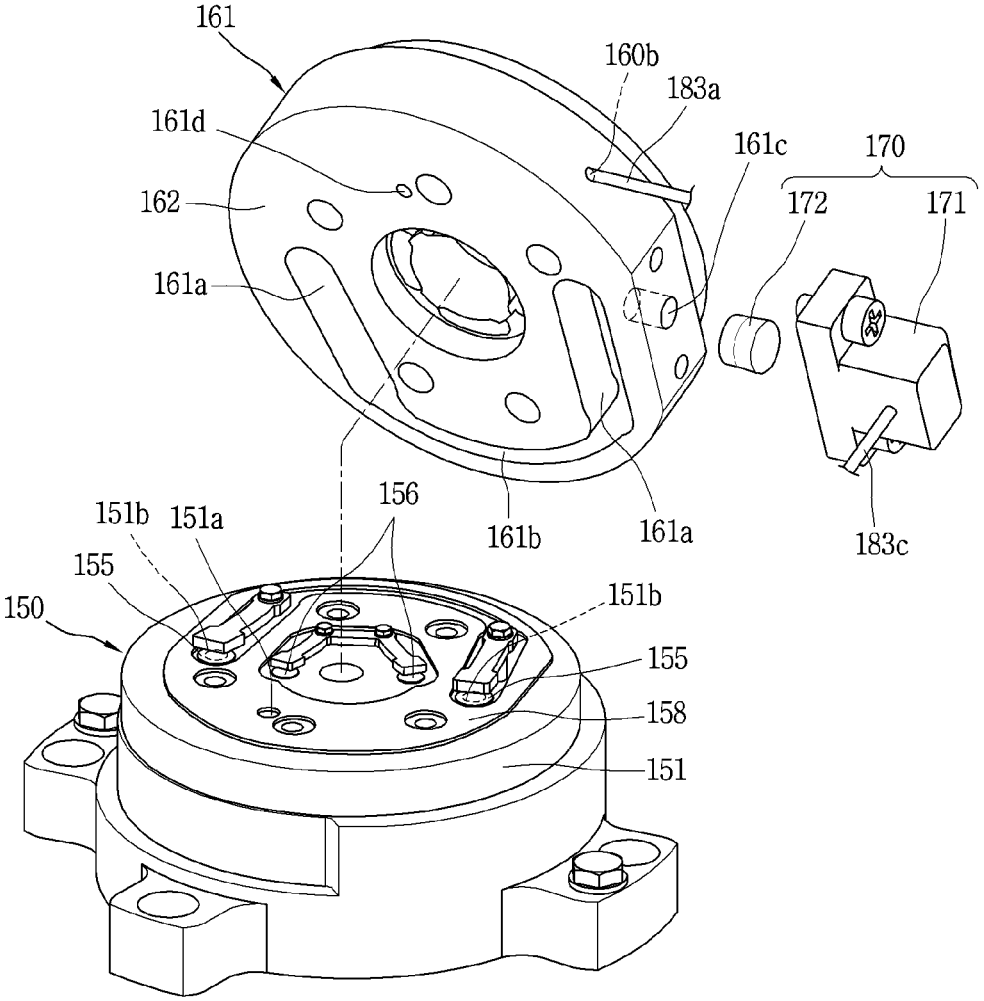
FIG. 2 is an exploded perspective view showing the capacity variable device of FIG. 1.
Figure 3:
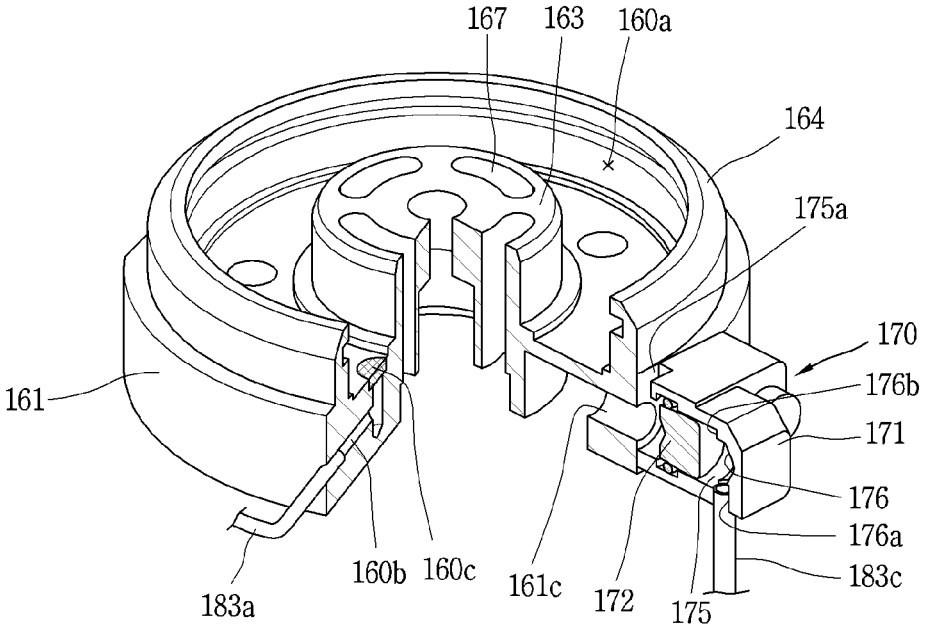
FIG. 3 is a cut-away perspective view showing part of a back pressure plate to which the capacity variable device according to an embodiment of the present disclosure is applied.
Figure 4:
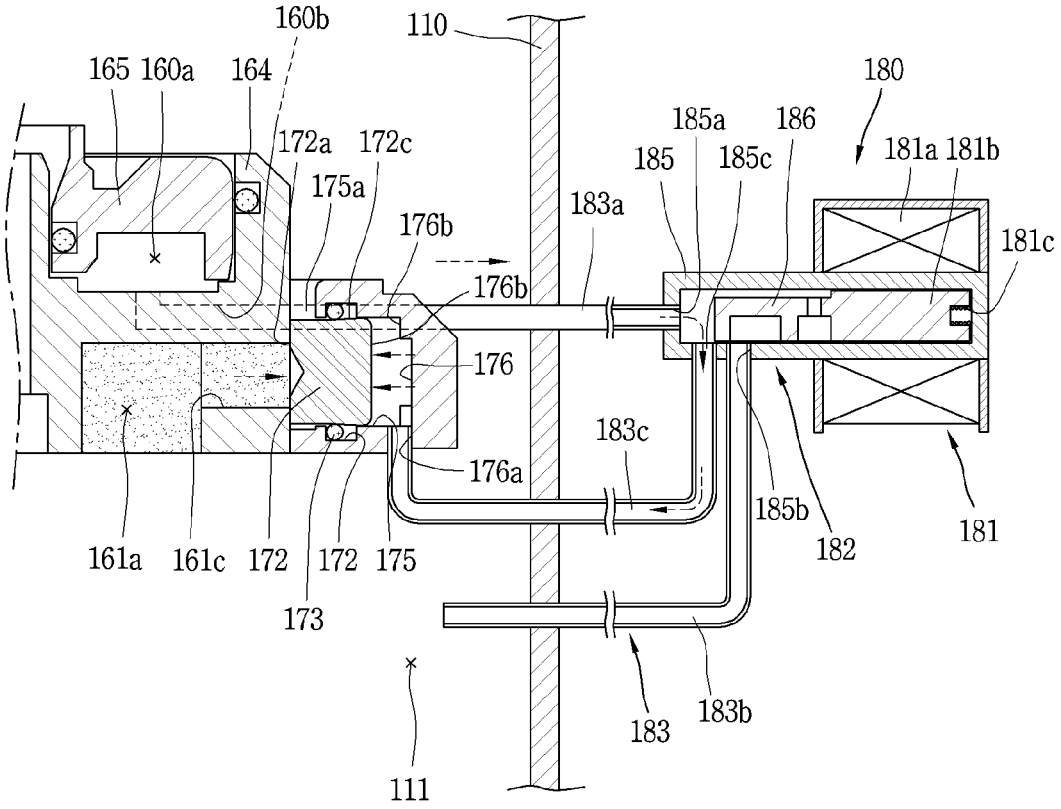
FIG. 4 is a sectional view showing the capacity variable device of FIG. 3.

When the capacity variable device is applied to the scroll compressor according to the present embodiment, some of the refrigerant compressed in the compression chamber is selectively bypassed toward the inner space of the casing according to the operation mode of the refrigerating machine, which leads to the variable capacity of the compressor. The capacity variable structure for the compressor is shown in the embodiments illustrated in FIGS. 2 to 4. FIG. 2 is an exploded perspective view showing the capacity variable device of FIG. 1. FIG. 3 is a cut-away perspective view showing part of the back pressure plate to which the capacity variable device according to the present embodiment is applied. FIG. 4 is a sectional view showing the capacity variable device of FIG. 3 for explanatory purposes.

As shown in FIG. 2, in the non-orbiting-side end plate portion 151, a capacity variable bypass hole 151*b* (hereinafter, referred to as a "first bypass hole") communicating with the intermediate pressure chamber is formed from the intermediate pressure chamber to the rear surface in a penetrating manner. First bypass holes 151*b* are arranged at both sides thereof with an interval of 180° so that the intermediate pressure refrigerant with the same pressure in the inner and outer pockets can be bypassed. However, in the case of an asymmetric structure in which orbiting wrap 142 has a larger wrap length than non-orbiting wrap 152 by 180°, the same pressure is formed at the same crank angle in the inner and outer pockets, and thus two first bypass holes 151*b* may be formed at the same crank angle or one first bypass hole 151*b* may be formed to communicate with both sides.

In turn, a bypass valve 155 (hereinafter, referred to as a "first bypass valve") capable of opening and closing first bypass hole 151*b* is provided at the end of first bypass hole 151*b*. First bypass valve 155 may be a lid-type valve that is opened and closed according to the pressure in the intermediate pressure chamber, but is not limited thereto.

Then, a plurality of intermediate pressure communication grooves 161*a* are formed in the lower surface of back pressure plate 161 corresponding to the rear surface of non-orbiting-side end plate portion 151 so as to receive first bypass valves 155, respectively. The plurality of intermediate pressure communication grooves 161*a* may be in communicate with each other through a connection passage groove 161*b*.

Thereafter, one end of a discharge hole 161*c* for guiding bypassed refrigerant to the suction space which is low pressure portion 111 of casing 110 is connected to one of the plurality of intermediate pressure communication grooves 161*a* or connection passage groove 161*b*. The other end of the discharge hole 161*c* is formed in the outer peripheral surface of the back pressure plate 161 in a penetrating manner. As such, the intermediate pressure communication groove 161*a*, the connection passage groove 161*b*, and the discharge hole 161*c* together form an intermediate pressure chamber receiving the intermediate pressure refrigerant when first bypass valve 155 is open.

In the meantime, a first valve assembly 170 in communication with the end of discharge hole 161*c* and selectively opening and closing discharge hole 161*c* according to the operation mode of the compressor is provided on the outer peripheral surface of back pressure plate 161.

As shown in FIGS. 3 and 4, the first valve assembly 170 may include a valve guide 171 and a check valve 172.

A valve receiving portion 175 is formed in valve guide 171 in the radial direction, and a differential pressure space portion 176 for supplying an operation pressure to the rear surface (back pressure surface) of check valve 172 inserted into the valve receiving portion 175 extends from valve receiving portion 175.

Exhaust holes 175*a* are formed in both upper and lower sides of valve receiving portion 175 to be in communication with discharge hole 161*c*, exhaust holes 175*a* are open when the check valve 172 is pushed backward to guide refrigerant discharged through the discharge hole 161*c* to the inner space of the casing 110 that is the low pressure portion 111.

An injection hole 176*a* is formed in one side of differential pressure space portion 176, and an end of a third connection pipe 183*c* (discussed in more detail below) is coupled to injection hole 176*a* so that third connection pipe 183*c* is in communication with differential pressure space portion 176. As such, the intermediate pressure or suction pressure refrigerant guided to third connection pipe 183*c* is selectively supplied to differential pressure space portion 176 through injection hole 176*a*.

Differential pressure space portion 176 has a smaller radial sectional area than valve receiving portion 175, and a stop surface 176*b* for supporting rear surface 172*b* of check valve 172 and restricting the pushing of check valve 172 is formed between differential pressure space portion 176 and valve receiving portion 175. Accordingly, injection hole 176*a* is formed on a side of differential pressure space portion 176 that is visible from stepped stop surface 176*b* between valve receiving portion 175 and differential pressure space portion 176.

In turn, differential pressure space portion 176 has a larger radial sectional area than discharge hole 161*c*. As such, when check valve 172 is closed, even if the pressure in discharge hole 161*c* is equal to the pressure in the differential pressure space portion 176, check valve 172 can remain closed. This is because the area applied from differential pressure space portion 176 to the rear surface 172*b* (e.g., back pressure surface) of check valve 172 is greater than the area applied from discharge hole 161*c* to the front surface 172*a* (e.g., opening/closing surface) of check valve 172.

Then, check valve 172 may be configured to move based on a pressure difference between opening/closing surface 172*a* and back pressure surface 172*b*. In some cases, for example, a pressure spring (not shown) such as a compression coil spring may be provided on the back pressure surface 172*b*. If the pressure spring is provided, when the intermediate pressure does not reach a sufficient pressure, such as during the startup of the compressor, and thus a low pressure is applied to the back pressure surface, the pressure spring pushes check valve 172 forward to prevent the check valve from being shaken or vibrated due to a low pressure difference between both sides.

Meanwhile, the scroll compressor of the present embodiment may further include a second valve assembly 180 to operate first valve assembly 170. Second valve assembly 180 selectively supplies an intermediate pressure or suction pressure to first valve assembly 170. In such configuration, first valve assembly 170 can be operated by a back pressure difference supplied by second valve assembly 180.

Second valve assembly 180 may include a solenoid valve that can be installed in the inner space of casing 110, but may preferably be installed outside casing 110 in order to increase design freedom. In this embodiment, the second valve assembly is installed outside of casing 110.

As shown in FIG. 4, the second valve assembly 180 may include a power supply portion 181, a valve portion 182, and a connection portion 183. Second valve assembly 180 includes a solenoid valve connected to an external power source and selectively operated according to the application of power.

In power supply portion 181, a mover 181*b* is provided inside a coil 181*a* receiving power, and a return spring 181*c* is provided at one end of mover 181*b*. A valve 186 for allowing a first inlet/outlet 185*a* and a third inlet/outlet 185*c* to be in communication with each other or a second inlet/outlet 185*b* and third inlet/outlet 185*c* to be in communication with each other is coupled to the mover 181*b*.

Valve portion 182 can be configured by slidably inserting a switch valve 186 extending from mover 181b of power supply portion 181 into a valve housing 185 coupled to power supply portion 181. It should be appreciated, however, that switch valve 186 may be rotated to change the flow direction of the refrigerant without being reciprocated, according to the structure of power supply portion 181. In the present exemplary embodiment, for convenience, a linear reciprocating valve is described.

Valve housing 185 is formed in an elongate cylindrical shape with three inlets/outlets in the longitudinal direction. The first inlet/outlet 185*a* is connected to back pressure chamber 160*a* through a first connection pipe 183*a* (discussed in more detail below), the second inlet/outlet 185*b* is connected to low pressure portion 111 of casing 110 through a second connection pipe 183*b* (discussed in more detail below), and the third inlet/outlet 185*c* is connected to differential pressure space portion 176 of first valve assembly 170 through a third connection pipe 183*c* (discussed in more detail below).

The connection portion 183 is composed of first connection pipe 183*a*, second connection pipe 183*b*, and third connection pipe 183c for selectively injecting the intermediate pressure or suction pressure refrigerant to first valve assembly 170. First connection pipe 183*a*, second connection pipe 183*b*, and third connection pipe 183*c* are coupled to casing 110 in a penetrating manner. They may be coupled to the casing by welding or some other fastening structure or process.

Here, one end of first connection pipe 183*a* is connected to first inlet/outlet 185*a* of valve housing 185, and the other end thereof is connected to intermediate pressure hole 160*b* communicating with back pressure chamber 160*a*. One end of second connection pipe 183*b* is connected to second inlet/outlet 185*b* of valve housing 185, and the other end thereof is connected to low pressure portion 111 of casing 110. One end of third connection pipe 183*c* is connected to third inlet/outlet 185*c* of valve housing 185, and the other end thereof is connected to injection hole 176*a* communicating with differential pressure space portion 176 of first valve assembly 170.

In the meantime, in first valve assembly 170, check valve 172 is a piston valve (not limited thereto) performing a sliding (e.g., moving) motion in valve guide 171, and thus a seal member 173, such as an 0-ring, may be provided between the outer peripheral surface of check valve 172 and the inner peripheral surface of valve guide 171.

Figure 5:
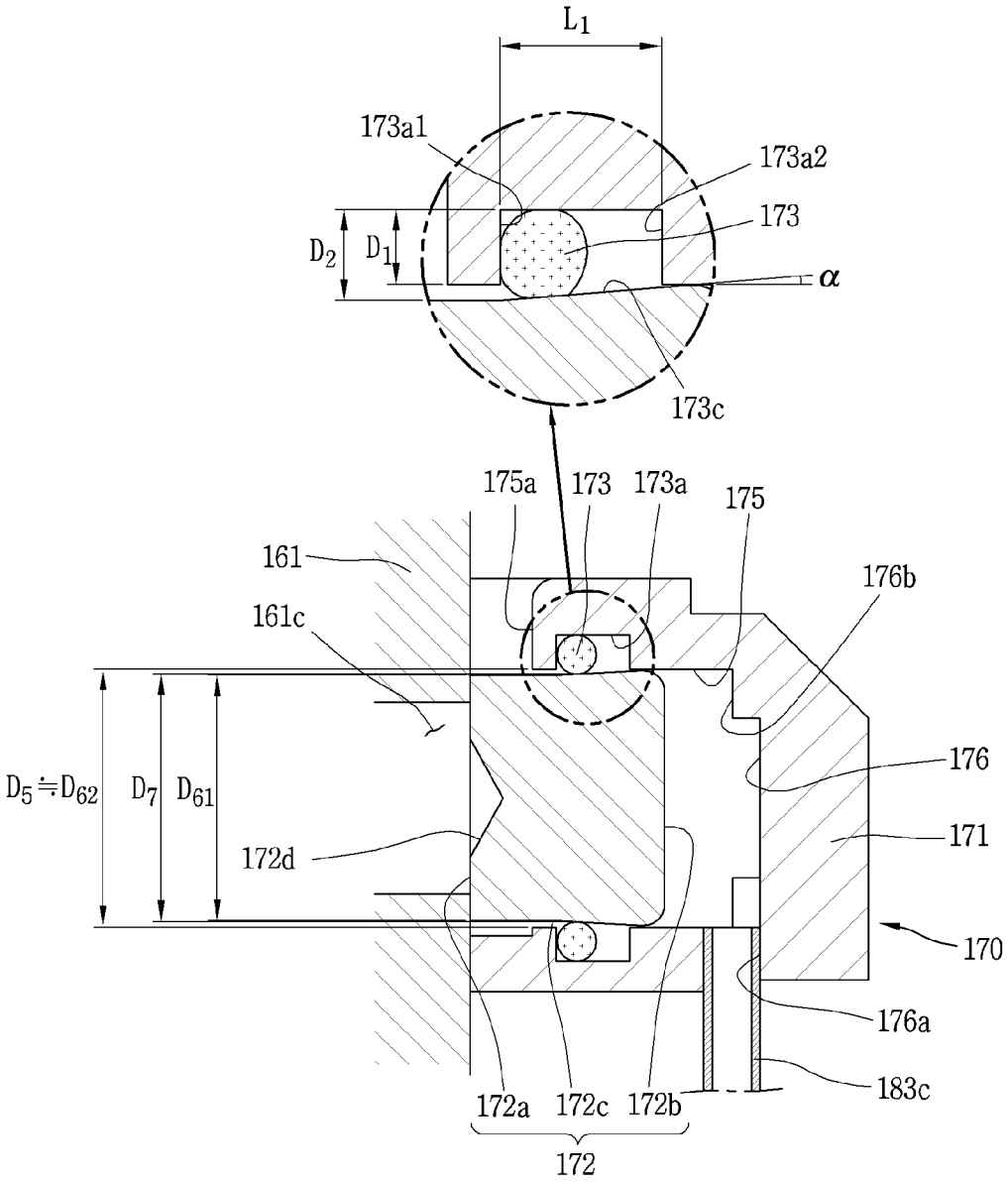
FIG. 5 is an enlarged sectional view showing a first valve assembly in the capacity variable device of FIG. 4.

Hereinafter, seal member 173 provided in valve guide 171 will be described. FIG. 5 is an enlarged sectional view showing an exemplary embodiment of the first valve assembly of the capacity variable device of FIG. 4.

As shown in FIG. 5, check valve 172 is formed in a cylindrical or circular rod-like shape, and the inner peripheral surface of valve receiving portion 175 of valve guide 171 has a circular sectional shape corresponding to check valve 172. The outer diameter of check valve 172 is substantially the same as the inner diameter of valve receiving portion 175. A seal receiving groove 173*a* into which a seal member 173 (discussed in more detail below) can be inserted is formed in the inner peripheral surface of valve receiving portion 175. Seal receiving groove 173*a* is formed in an annular shape, considering that the seal member 173 is composed of an annular O-ring.

The depth D1 of seal receiving groove 173*a* may be smaller than the outer diameter D2 of seal member 173 so that seal member 173 can be closely attached to the outer peripheral surface of check valve 172. The length L1 of seal receiving groove 173*a* may be larger than the outer diameter D1 of seal member 173 so that seal member 173 can move along check valve 172 by a given distance. Then, the depth D2 of seal receiving groove 173*a* may be constant or substantially constant along the longitudinal direction from the front surface 173*a*1 (opening/closing surface of the seal member) to the rear surface 173*a*2 (back pressure surface of the seal member).

In the meantime, as described above, check valve 172 may be a type of piston valve (not limited thereto) that slidably moves according to the pressure difference between opening/closing surface 172*a* and back pressure surface 172*b* to open and close discharge hole 161*c* and may be formed in a cylindrical or circular rod shape like valve receiving portion 175.

In addition, check valve 172 moves according to the pressure difference between differential pressure space portion 176 and discharge hole 161*c*, and thus opening/closing surface 172*a* and back pressure surface 172*b* of check valve 172 may contact the outer surface of back pressure plate 161 or the step difference surface of valve guide 171. Therefore, check valve 172 may be made of a material having a sufficient rigidity not to be damaged due to contact or collision, reduces or minimizes noise in the event of collision, and is smoothly slidable, such as an engineered plastic material. However, check valve 171 may be preferably made of aluminum having excellent roughness after the processing, considering that its outer peripheral surface is inclined.

Further, check valve 172 may be formed in a circular sectional shape with the substantially the same outer diameter as the inner diameter of valve receiving portion 175 from opening/closing surface 172*a* to back pressure surface 172*b*. However, if the inner diameter of valve receiving portion 175 and the outer diameter of check valve 172 are constant along the longitudinal direction, respectively, the numerical values of the seal member 173 or the check valve 172 must be precisely controlled. When the inner diameter D5 of valve receiving portion 175 and the outer diameter D6 of check valve 172 are constant along the longitudinal direction, respectively, if the inner diameter D7 of seal member 173 is too small, the squeeze of seal member 173 increases, and if the inner diameter D7 of seal member 173 is too large, the squeeze of seal member 173 decreases.

If the squeeze of seal member 173 increases, in the saving operation, the opening operation of check valve 172 is delayed by the frictional force of seal member 173, which results in a passage resistance. On the contrary, if the squeeze of seal member 173 decreases, in the power operation, check valve 172 and seal member 173 are not closely attached to each other, thereby reducing the sealing effect of the refrigerant in the compression chamber.

Thus, when the inner diameter D5 of valve receiving portion 175 and the outer diameter D61 and D62 of check valve 172 are constant along the longitudinal direction, respectively, the distance between the outer diameter D61 and D62 of check valve 172 and inner diameter D7 of the seal member 173 must be controlled. However, when using the relatively low-cost O-ring made of rubber as seal member 173, it is difficult to appropriately manage the distance between the outer diameter D61 and D62 of check valve 172 and the inner diameter D7 of seal member 173. It is understood here that the squeeze of the seal member 173 is the distance between seal receiving groove 173*a* into which seal member 173 which is composed of the O-ring is inserted and received and the sealing surface which seal member 173 slidably contacts.

In view of this, in the present embodiment, an inclined surface 172*c* is formed on the outer peripheral surface of check valve 172, so that the squeeze of seal member 173 can be variable according to the operation mode. Accordingly, even with an O-ring made of rubber, it is possible to restrict refrigerant leakage generated by a small squeeze of the O-ring in the power operation or to restrict a passage resistance generated by a large squeeze in the saving operation.

Figure 6:
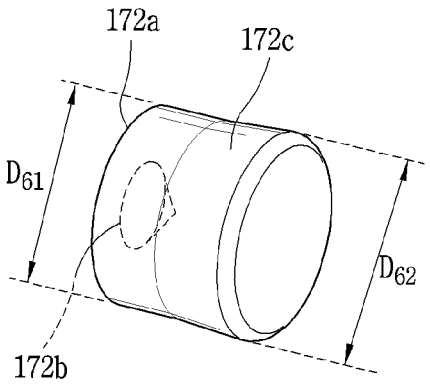
FIG. 6 is an enlarged perspective view showing a check valve in the first valve assembly of FIG. 5.
Figure 7:
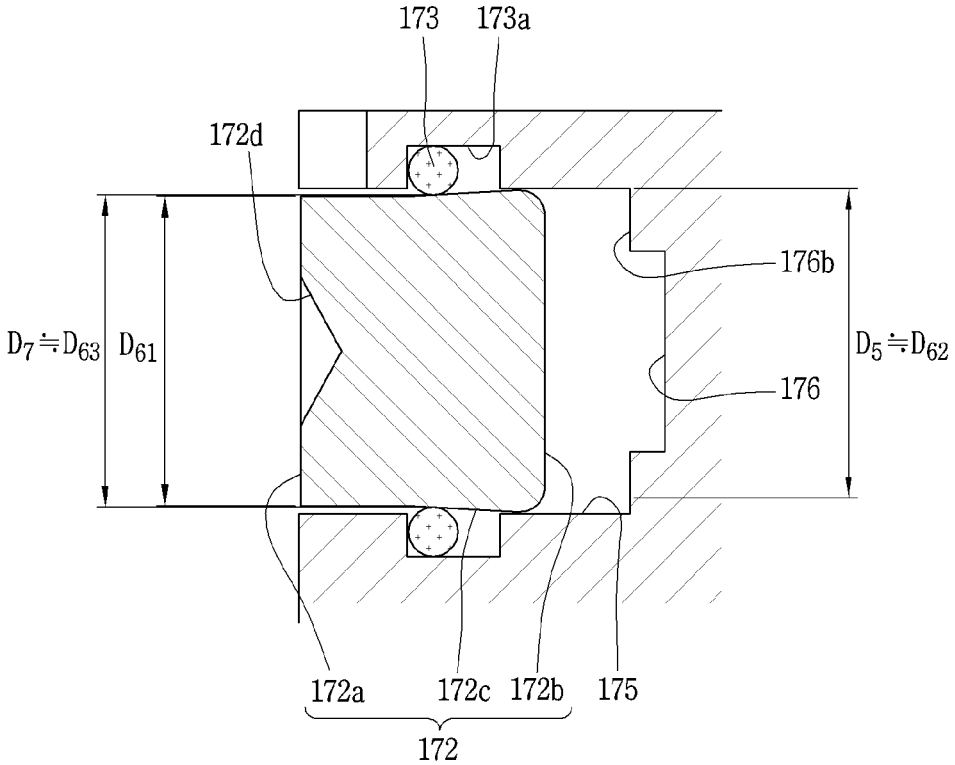
FIG. 7 is a schematic view showing an exemplary relationship between a valve guide and the check valve in the first valve assembly of FIG. 5.

FIG. 6 is an enlarged perspective view showing the check valve in the first valve assembly of FIG. 5. FIG. 7 is a schematic view showing the relationship between the valve guide and the check valve in the first valve assembly of FIG. 5 for explanatory purposes.

As shown, check valve 172 may be formed in a circular rod shape, considering the inner peripheral surface of valve receiving portion 175, as described above, in which case the outer peripheral surface of check valve 172 is formed in a circular sectional shape. However, check valve 172 may be configured such that a diameter D61 (minimum outer diameter) of opening/closing surface 172*a* and a diameter D62 (maximum outer diameter) of back pressure surface 172*b*, that compose both ends, are different.

For example, inclined surface 172*c* may be formed on the outer peripheral surface of check valve 172 so that the diameter decreases in a direction from back pressure surface 172*b* toward opening/closing surface 172*a* (D62→D61). Accordingly, the maximum outer diameter D62 that is the outer diameter on the side of the back pressure surface of check valve 172 is equal to the inner diameter D5 of valve receiving portion 175, and the minimum outer diameter D61 that is the outer diameter on the side of the opening/closing surface of check valve 172 is less than the inner diameter D5 of the valve receiving portion 175. In turn, the inner diameter D7 of the seal member 173 is generally greater than the minimum outer diameter D61 that is the inner diameter on the side of the opening/closing surface of check valve 172, but may be less than or equal to the maximum outer diameter D62 that is the inner diameter on the side of the back pressure surface of check valve 172. Therefore, when seal member 173 having elasticity performs a relative motion on inclined surface 172*c* of check valve 172, seal member 173 is pressed by inclined surface 172*c* of check valve 172 to have a reduced thickness, and the inner diameter D7 of seal member 173 increases to the outer diameter D63 on the side of the inclined surface of check valve 172.

Here, inclined surface 172*c* may be formed on part of the outer peripheral surface of check valve 172 along the peripheral direction, but may be preferably evenly formed on the outer peripheral surface of the check valve 172 along the peripheral direction, considering that check valve 172 can rotate, as provided in the embodiments illustrated in FIGS. 6 and 7.

Also, inclined surface 172*c* may be formed on the outer peripheral surface of check valve 172 from opening/closing surface 172*a* to the back pressure surface 172*b*. However, in this case, both ends have a different diameter, and as a result, the size of back pressure surface 172*b* becomes large, and the size of first valve assembly 170 may increase. Accordingly, it may be preferable to form inclined surface 172*c* in a necessary part thereof, e.g., within a length range in which check valve 172 contacts the seal member 173 when it slidably moves, so as to minimize a diameter difference between both ends of check valve 172. Then, the outer peripheral surface of check valve 172 may be formed in the order of the straight surface-inclined surface or the straight surface-inclined surface-straight surface in a direction from opening/closing surface 172*a* to back pressure surface 172*b*. Thus, check valve 172 may be configured such that the area of opening/closing surface 172*a* is smaller than the area of back pressure surface 172*b*.

In turn, as opening/closing surface 172*a* and back pressure surface 172*b* of check valve 172 have directivity, it may be preferable to form a mark portion 172*d* on either opening/closing surface 172*a* or back pressure surface 172*b* to assist for assembly procedure, e.g., to prevent a mis-assembly of opening/closing surface 172*a* and back pressure surface 172*b*.

Meanwhile, stop surface 176*b* discussed earlier may be formed in a step-like manner on the inner surface of valve guide 171, e.g., at a boundary part between valve receiving portion 175 and differential pressure space portion 176. The sectional area of stop surface 176*b* is smaller than the sectional area of differential pressure space portion 176. Accordingly, when check valve 172 is pushed in a direction toward differential pressure space portion 176, back pressure surface 172*b*, of check valve 172 makes contact with stop surface 176*b*, which then restricts the backward movement. Here, the sectional area of stop surface 176*b* is smaller than the sectional area of differential pressure space portion 176, which reduces a collision force and thus noise when check valve 172 hits stop surface 176*b*. At the same time, adhesion between check valve 172 and stop surface 176*b* reduces, so that check valve 172 can more rapidly move to the closing direction.

Reference numeral a denotes an inclination angle of the inclined surface.

Figure 8A:
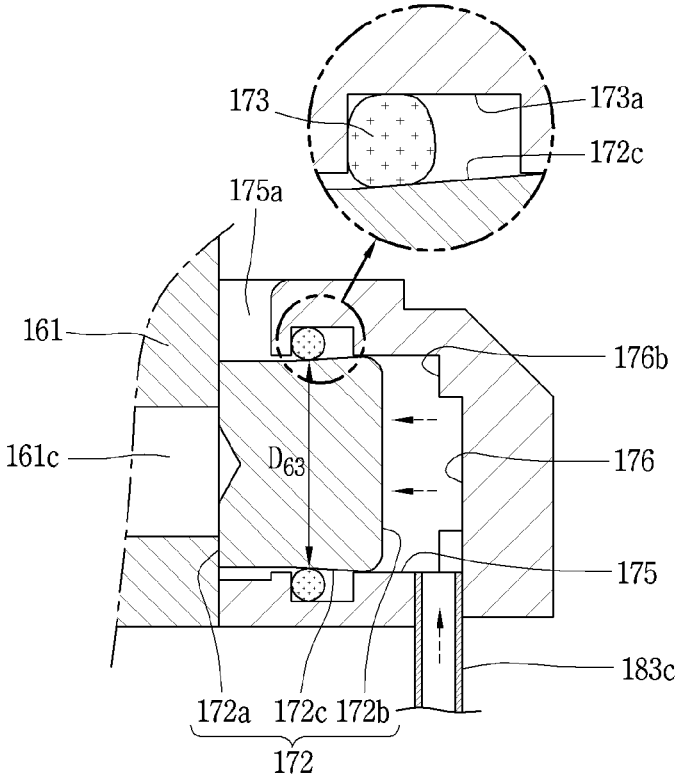
FIG. 8A is a sectional view showing the power operation in the scroll compressor having the capacity variable device according to an embodiment of the present disclosure.
Figure 8B:
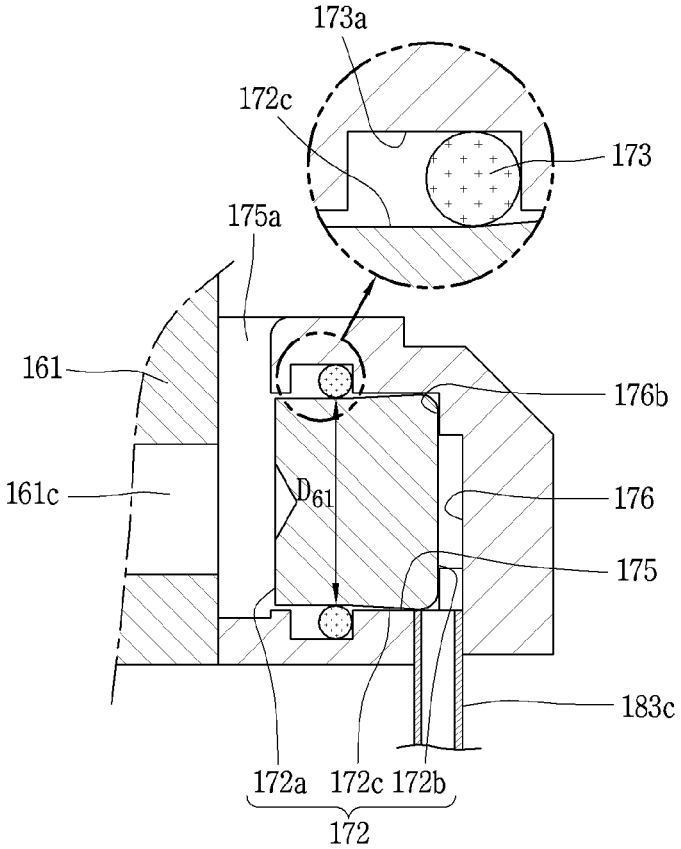
FIG. 8B is a sectional view showing saving operation in the scroll compressor having the capacity variable device according to an embodiment of the present disclosure.

The operation of the scroll compressor according to the embodiment of present embodiment described above will now be described. FIGS. 8A and 8B are sectional views showing the power operation and the saving operation in the scroll compressor having the capacity variable device according to the present embodiment.

That is, as shown in FIG. 8A, in the power operation, when power is applied to power supply portion 181 of second valve assembly 180 and mover 181*b* is pulled toward coil 181*a*, switch valve 186 coupled to the mover 181*b* moves in a direction toward coil 181*a* (right side of FIG. 8), which allows first inlet/outlet 185*a* and third inlet/outlet 185*c* of the valve housing 185 to be in communication with each other.

In turn, the intermediate pressure refrigerant of back pressure chamber 160*a* is transferred to valve housing 185 through first connection pipe 183*a* connected to first inlet/outlet 185*a*, and then transferred to differential pressure space portion 176 of first valve assembly 170 through third connection pipe 183*c* connected to third inlet/outlet 185*c*.

Then, the pressure in differential pressure space portion 176 pushes check valve 172 of first valve assembly toward discharge hole 161*c* while forming an intermediate pressure, and check valve 172 moves in a direction toward discharge hole 161*c* along the inner peripheral surface of the valve receiving portion to block discharge hole 161*c*.

Here, as seal member 173 composed of an O-ring is inserted into seal receiving groove 173*a* provided in the inner peripheral surface of valve receiving portion 175, the inner peripheral surface of seal member 173 and the outer peripheral surface of check valve 172 are closely attached to each other, to be able to block the gap between block receiving portion 175 and differential pressure space portion 176. As such, check valve 172 can more securely seal discharge hole 161*c* by restricting the refrigerant of differential pressure space portion 176 that has an intermediate pressure relatively higher than the refrigerant of discharge hole 161*c* from being leaked to valve receiving portion 175. Here, a small gap may be created between check valve 172 and seal member 173 based on a tolerance or a sliding operation of check valve 172.

However, as in the present embodiment, when the depth D1 of seal receiving groove 173*a* is constant in the longitudinal direction and the outer diameter of check valve 172 is inclined to increase in a direction toward back pressure surface 172*b*, i.e., toward the opposite side of the discharge hole 161*c*, the more check valve 172 is adjacent to discharge hole 161*c* (e.g., as check valve 172 moves closer to discharge hole 161*c*), the squeeze of seal member 173 increases. Then, as check valve 172 moves toward discharge hole 161*c*, seal member 173 is more strongly pressed, and thus seal member 173 and check valve 172 are more closely attached, which results in an improved sealing force.

Moreover, as in the present embodiment, when seal receiving groove 173*a* is elongate, while check valve 172 moves in the closing direction, seal member 173 moves together along seal receiving groove 173*a* by a predetermined distance. However, when seal member 173 cannot move due to the front wall of seal receiving groove 173*a*, as described above, the inner peripheral surface of seal member 173 is pressed, closely attached to the outer peripheral surface of check valve 172, which results in a high sealing force.

As such, even if some of the refrigerant is discharged from the intermediate pressure chamber of the compression chamber P to intermediate pressure communication groove 161*a* through first bypass hole 151*b*, this refrigerant remains in intermediate pressure communication groove 161*a*, connection passage groove 161*b*, and discharge hole 161*c*. Accordingly, in the power operation, refrigerant compressed in the compression chamber may be prevented from being leaked through the valve receiving portion, which improves energy efficiency.

On the contrary, as shown in FIG. 8B, in the saving operation, power supply to power supply portion 181 of second valve assembly 180 is cut off, and thus mover 181*b* is pushed to the opposite side of coil 181*a* by return spring 181*c*.

Then, switch valve 186 coupled to mover 181*b* moves to the opposite side of coil 181*a* (left side of FIG. 8B), which allows second inlet/outlet 185*b* and third inlet/outlet 185*c* of valve housing 185 to be in communication with the each other.

In turn, the suction pressure refrigerant is transferred to valve housing 185 through second connection pipe 183*b* connected to second inlet/outlet 185*b*, in communication with low pressure portion 111 of casing 110, and then transferred to differential pressure space portion 176 of first valve assembly 170 through third connection pipe 183*c* connected to third inlet/outlet 185*c*.

Then, the pressure in differential pressure space portion 176 defines a suction pressure, which pushes check valve 172 of first valve assembly 170 in a direction toward differential pressure space portion 176 due to the pressure in discharge hole 161*c* that defines an intermediate pressure, to open discharge hole 161*c*.

Here, as the inner peripheral surface of seal member 173 and the outer peripheral surface of check valve 172 remain closely attached to each other, check valve 172 cannot rapidly move, so that opening/closing surface 172*a* of check valve 172 may generate a passage resistance. In such case, refrigerant that is discharged through discharge hole 161*c* cannot be rapidly discharged, which results in a reduced capacity variable ratio of the compressor.

However, as in the present embodiment, when the depth D1 of seal receiving groove 173*a* is constant in the longitudinal direction and the outer diameter of check valve 172 is inclined to decrease toward opening/closing surface 172*a*, i.e., toward the discharge hole 161*c*, the more check valve 172 is distant from discharge hole 161*c* (e.g., the further away check valve 172 is from discharge hole 161*c*), the squeeze of seal member 173 contacting check valve 712 gradually decreases. Then, as check valve 172 moves toward differential pressure space portion 176, the frictional force between seal member 173 and check valve 172 gradually decreases, and thus seal member 173 can more rapidly open.

Moreover, as in the present embodiment, when seal receiving groove 173*a* is elongate, while check valve 172 moves away from discharge hole 161*c*, seal member 173 also moves together along seal receiving groove 173*a* by a predetermined distance. Accordingly, the frictional force between seal member 173 and check valve 172 decreases, so that seal member 173 can be more rapidly open.

As such, the refrigerant already filled in intermediate pressure communication groove 161*a*, connection passage groove 161*b*, and discharge hole 161*c* through the first bypass hole 151*b* is rapidly discharged to he valve receiving portion 175 of first valve assembly 170, and then rapidly discharged to low pressure portion 111 of casing 110 through exhaust hole 175*a* formed in valve receiving portion 175. In turn, at least a portion of the refrigerant in the intermediate pressure chamber of the compression chamber P is continuously discharged along the above path, so that the compressor continues to rapidly and stably perform the saving operation.

On the other hand, another embodiment of the first valve assembly of the scroll compressor according to the present invention will now be described.

Figure 9A:
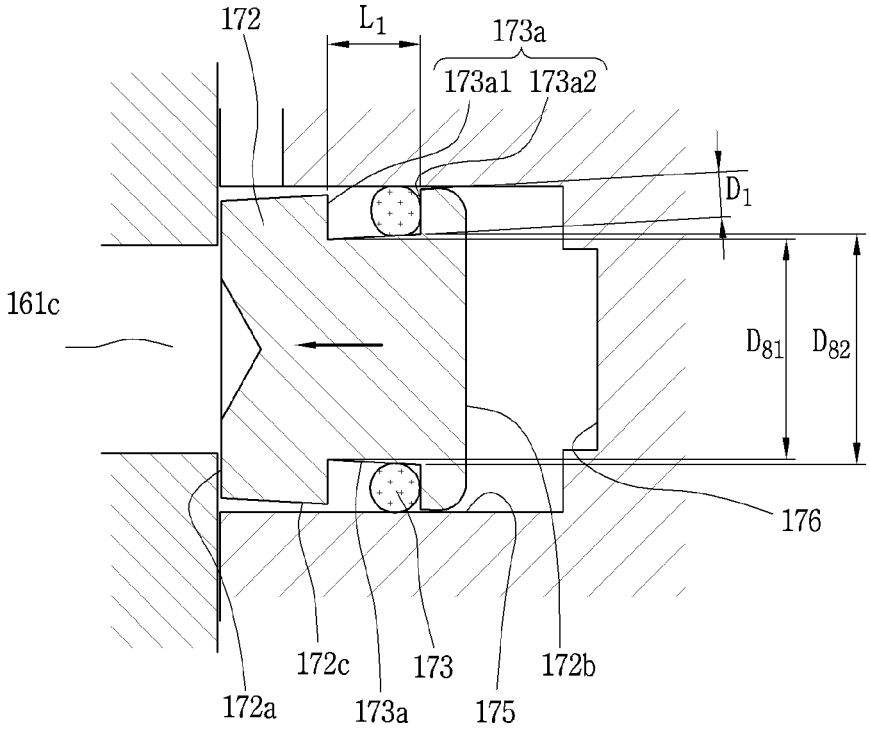
FIG. 9A is a sectional view showing an example in which a seal member is inserted onto the check valve in the first valve assembly according to an embodiment of the present disclosure during the power operation.
Figure 9B:
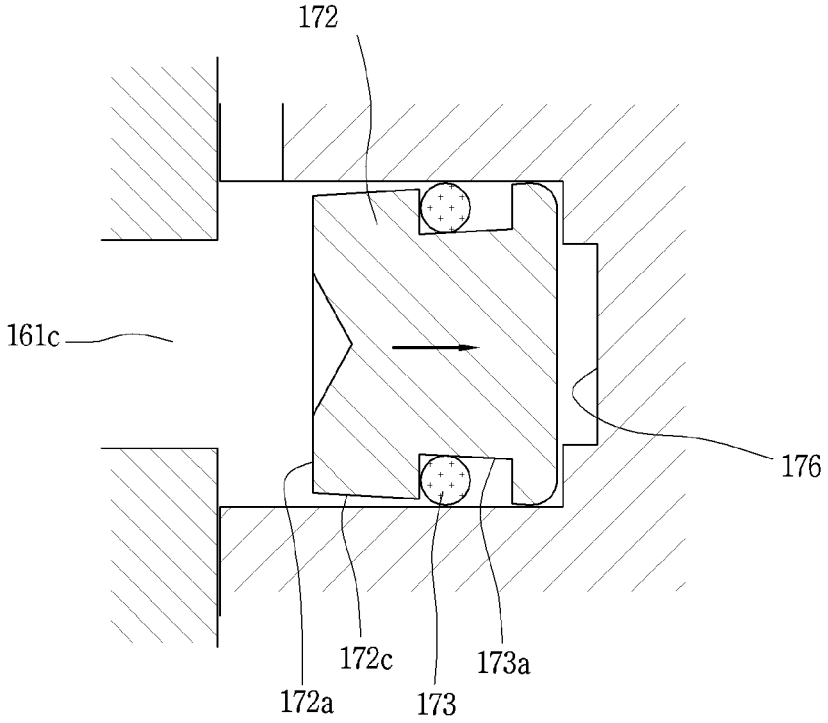
FIG. 9B is a sectional view showing an example in which a seal member is inserted onto the check valve in the first valve assembly according to an embodiment of the present disclosure during the saving operation.

That is, in the above-described embodiment, the seal member is inserted onto the inner peripheral surface of the valve receiving portion so that the distance between the seal receiving portion into which the seal member is inserted and the sealing surface which the seal member slidably contacts is variable along the moving direction of the valve member. However, as in the present embodiment, the seal member may be inserted onto the outer peripheral surface of the check valve. FIGS. 9A and 9B are sectional views showing examples in which the seal member is inserted onto the check valve in the first valve assembly according to the present invention during the power operation (FIG. 9A) and the saving operation (FIG. 9B), respectively.

As shown, first valve assembly 170 according to the present invention may include valve receiving portion 175 provided in valve guide 171, check valve 172 slidably inserted into valve receiving portion 175, and seal member 173 inserted onto the outer peripheral surface of check valve 172.

Here, as in the embodiment of FIGS. 9A and 9B, the inner diameter of valve receiving portion 175 may be the same at both ends, whereas the outer diameter of check valve 172 may be different at both ends. That is, the outer diameter of check valve 172 may decrease in a direction toward discharge hole 161*c* and increase in a direction away from discharge hole 161*c*. Therefore, with respect to the sectional area of check valve 172, the sectional area of opening/closing surface 172*a* is smaller than the sectional area of back pressure surface 172*b*.

Then, seal receiving groove 173*a* may be formed in the outer peripheral surface of check valve 172, the length L1 of seal receiving groove 173*a* being larger than the diameter D2 of seal member 173, the depth D1 of seal receiving groove 173*a* being constant along the longitudinal direction from a front surface 173*a*1 thereof to a rear surface 173*a*2 thereof. Accordingly, with respect to the diameter of seal receiving groove 173*a*, the diameter D81 adjacent to discharge hole 161*c* (i.e., away from the differential pressure space portion) is smaller than the diameter D82 of the opposite side (i.e., adjacent to the differential pressure space portion), so that an inclined surface having the same angle as the outer peripheral surface of check valve 172 provided outside seal receiving groove 173*a* may be formed between front surface 173*a*1 and rear surface 173*a*2 of seal receiving groove 173*a*. Therefore, the minimum diameter D81 of the main surface (inclined surface) of seal receiving groove 173*a* corresponding to the inner peripheral surface of seal member 173 may be less than or equal to the inner diameter of seal member 173, and the maximum diameter D82 of the main surface (inclined surface) of seal receiving groove 173*a* may be larger than the inner diameter of seal member 173.

It is because, as seal member 173 is provided on check valve 172 unlike the above-described embodiment, the squeeze of seal member 173 should be reversely formed. For example, in the power operation of FIG. 9A, when check valve 172 moves in the closing direction (i.e., in a direction toward the discharge hole), the squeeze of seal member 173 should be increased so as to improve the sealing force between seal member 173 and valve receiving portion 175. To the contrary, in the saving operation of FIG. 9B, when check valve 172 moves in the opening direction (i.e., in a direction away from the discharge hole), the squeeze of seal member 173 should be decreased to reduce the frictional force between seal member 173 and valve receiving portion 175.

The basic structure and thus operation and effect of the scroll compressor including the first valve assembly according to the present embodiment as described above are similar to those of the above-described embodiment. However, in the present embodiment, as described above, seal member 173 is coupled to the outer peripheral surface of check valve 172, unlike the above-described embodiment, which improves the workability and reliability of seal member 173 composed of the O-ring.

That is, in the present embodiment, as seal member 173 is made of rubber having elasticity, when seal member 173 is coupled to seal receiving groove 173*a* provided in the outer peripheral surface of check valve 172, seal member 173 is extended to be inserted onto check valve 172. Accordingly, there is a relatively sufficient tolerance on the processing precision of seal member 173 or check valve 172, as compared with the above-described embodiment, which makes it possible to facilitate the processing of seal member 173 or check valve 172 and improve reliability.

Figure 10A:
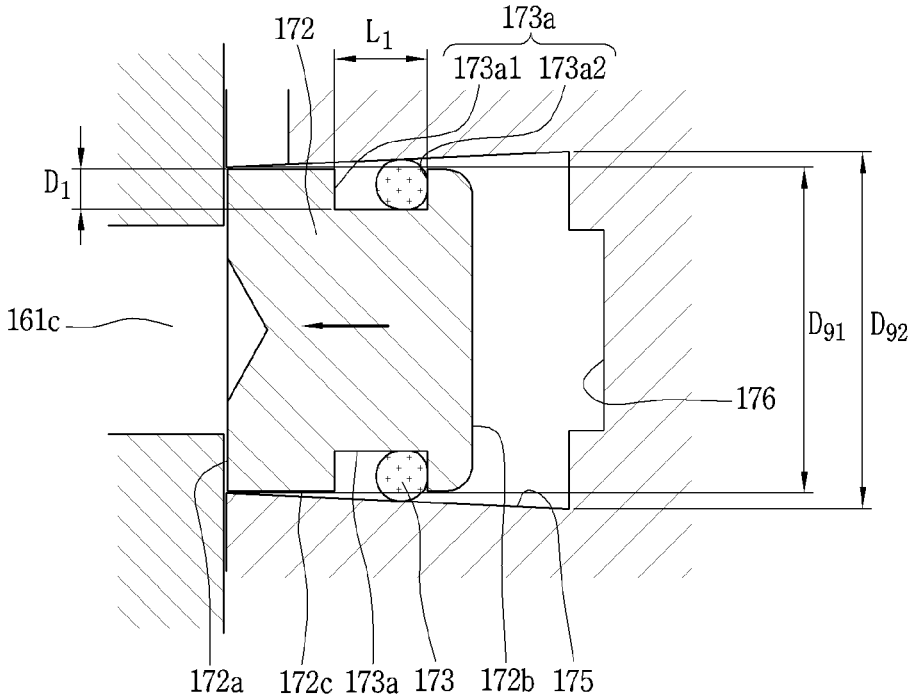
FIG. 10A is sectional view showing another example in which the seal member is inserted onto the check valve in the first valve assembly according to an embodiment of the present disclosure during the power operation.
Figure 10B:
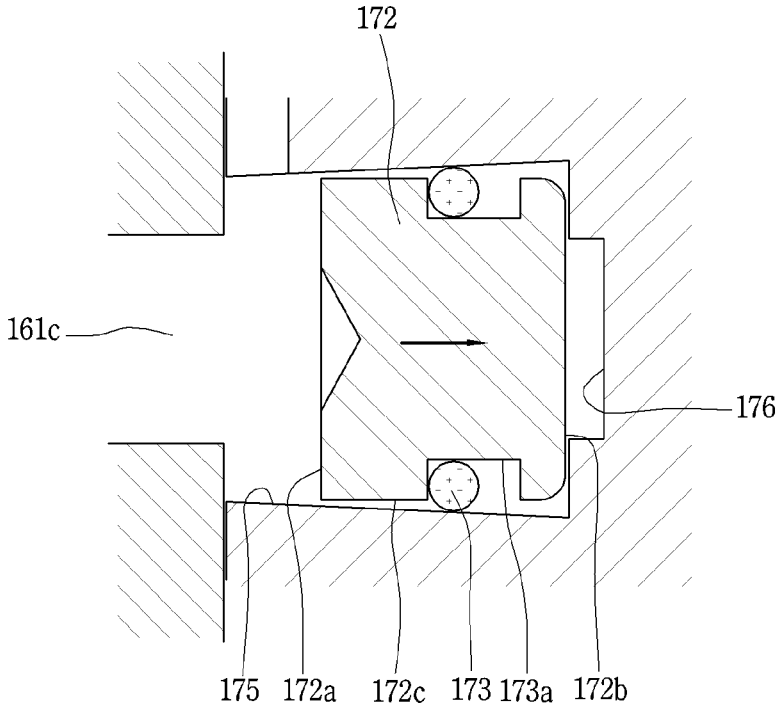
FIG. 10B is sectional view showing another example in which the seal member is inserted onto the check valve in the first valve assembly according to an embodiment of the present disclosure during the saving operation.

On the other hand, a further embodiment of the first valve assembly according to the present invention will now be described. That is, in the above-described embodiment, the seal member is coupled to the check valve, the check valve having a variable outer diameter, but in the present embodiment, the seal member is coupled to the check valve, the check valve having a constant outer diameter and a variable inner diameter. FIGS. 10A and 10B are sectional views showing another examples in which the seal member is inserted onto the check valve in the first valve assembly according to the present invention during the power operation (FIG. 10A) and the saving operation (FIG. 10B), respectively.

As shown, the inner diameter of valve receiving portion 175 may be different at both ends, whereas the outer diameter of check valve 172 may be the same at both ends. That is, the inner diameter D91 of valve receiving portion 175 may increase in a direction toward discharge hole 161*c* and the inner diameter D92 of valve receiving portion 175 may decrease in a direction away from discharge hole 161*c*. Therefore, with respect to the sectional area of valve receiving portion 175, the sectional area of the opening surface (on the side of the opening/closing surface with respect to the check valve) is larger than the sectional area of the closing surface (on the side of the back pressure surface with respect to the check valve), so that at least part of the inner peripheral surface of the valve receiving portion includes an inclined surface.

In addition, seal receiving groove 173*a* may be formed in the outer peripheral surface of check valve 172, and the length L1 and the depth D1 of seal receiving groove 173*a* may be the same as those of the above-described embodiment of FIGS. 9A and 9B. It is because, as seal member 173 is provided on check valve 172 unlike the above-described embodiment, the squeeze of seal member 173 should be reversely formed. Accordingly, the minimum diameter D91 part of the inner peripheral surface of valve receiving portion 175 composing the inclined surface may be equal to or smaller than the outer diameter of seal member 173, and the maximum diameter D92 part may be larger than the outer diameter of seal member 173.

In the case of the present embodiment, in the power operation of FIG. 10A, when check valve 172 moves in the closing direction (i.e., in a direction toward the discharge hole), the squeeze of seal member 173 should be increased to improve the sealing force between seal member 173 and valve receiving portion 175. On the contrary, in the saving operation of FIG. 10B, when check valve 172 moves in the opening direction (i.e., in a direction away from the discharge hole), the squeeze of seal member 173 should be decreased to reduce the frictional force between seal member 173 and valve receiving portion 175.

The basic structure and thus operation and effect of the scroll compressor including the first valve assembly according to the present embodiment as described above are similar to those of the above-described embodiment. However, in the present embodiment, as described above, seal member 173 is inserted onto the outer peripheral surface of check valve 172, so that seal member 173 or the check valve 172 can be more easily processed.

On the other hand, a still further embodiment of the first valve assembly in the scroll compressor according to the present invention will now be described.

That is, in the above-described embodiments, the inclined surface is formed on the outer peripheral surface of the check valve or the inner peripheral surface of the valve receiving portion, but in the present embodiment, the inclined surface is formed on the main surface of the seal receiving groove. FIGS. 11A to 12B are sectional views showing the power operation and the saving operation for the seal receiving grooves in the first valve assembly according to the present embodiment, respectively.

Figure 11A:
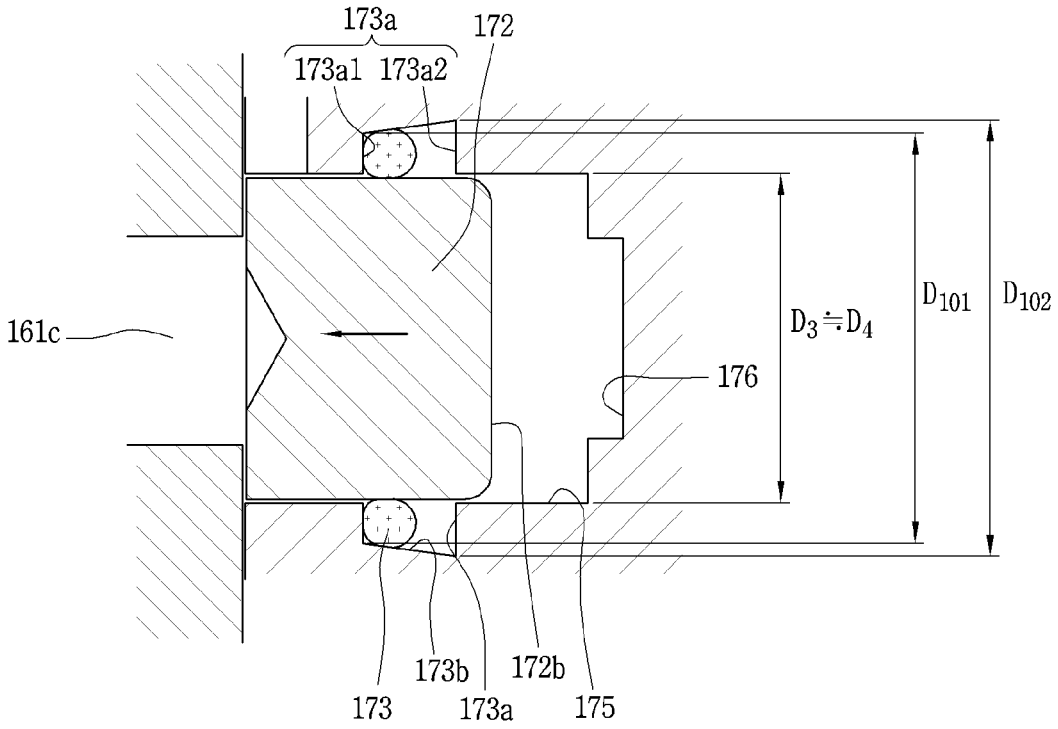
FIG. 11A is a sectional view showing the power operation and the saving operation for seal receiving grooves in the first valve assembly according to an embodiment of the present disclosure.
Figure 11B:
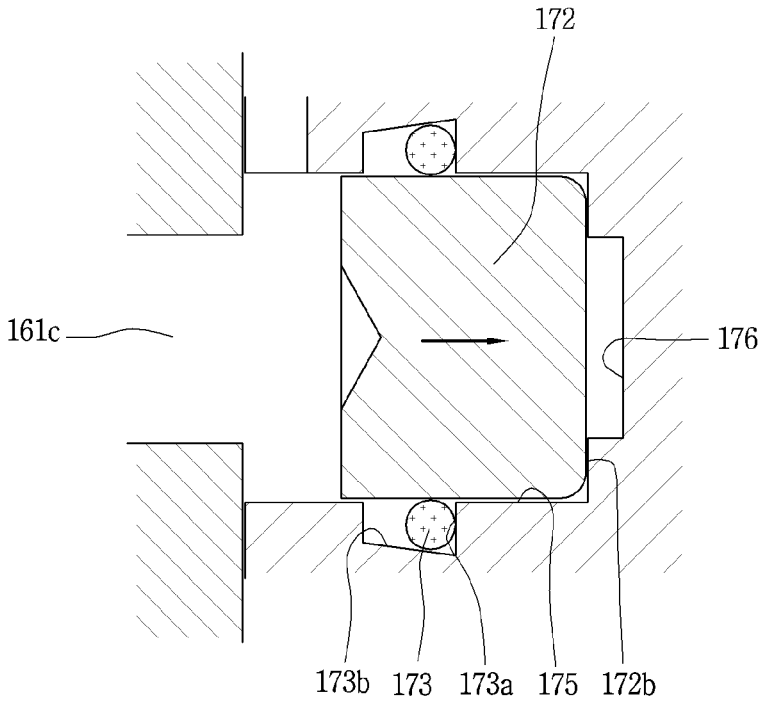
FIG. 11B is a sectional view showing the power operation and the saving operation for seal receiving grooves in the first valve assembly according to an embodiment of the present disclosure.

As shown in FIGS. 11A and 11B, when seal member 173 is coupled to the inner peripheral surface of valve receiving portion 175, the inner diameter D3 of valve receiving portion 175 and the outer diameter D4 of check valve 172 may be substantially constant along the longitudinal direction, respectively, and the inner diameter of the main surface of seal receiving groove 173*a* may be variable along the longitudinal direction. For example, the inner diameter D101 of seal receiving groove 173*a* that is close to discharge hole 161*c* may be smaller than the inner diameter D102 that is distant from discharge hole 161*c*. Accordingly, an inclined surface 173*b* is formed on the inner peripheral surface of seal receiving groove 173*a*, so that the depth of seal receiving groove 173*a* may gradually increase in a direction toward differential pressure space portion 176. That is, the depth of seal receiving groove 173*a* may increase from front surface 173*a*1 to rear surface 173*a*2. Thus, the minimum diameter of seal receiving groove 173*a* may be less than or equal to the outer diameter of seal member 173, and the maximum diameter of seal receiving groove 173*a* may be larger than the outer diameter of seal member 173.

When inclined surface 173*b* is formed on the inner peripheral surface of seal receiving groove 173*a* provided in the inner peripheral surface of valve receiving portion 175, the general operational effect is similar to that of the above-described embodiment. That is, the squeeze of seal member 173 defined as the distance between the outer peripheral surface of check valve 172 composing the sealing surface and seal receiving groove 173*a* increases as check valve 172 moves in the closing direction and decreases as check valve 172 moves in the opening direction. Thus, in the power operation of FIG. 11A, the sealing force between check valve 172 and seal member 173 may be increased to improve energy efficiency, and in the saving operation of FIG. 11B, the frictional force between check valve 172 and seal member 173 may be decreased to improve energy saving effects.

Figure 12A:
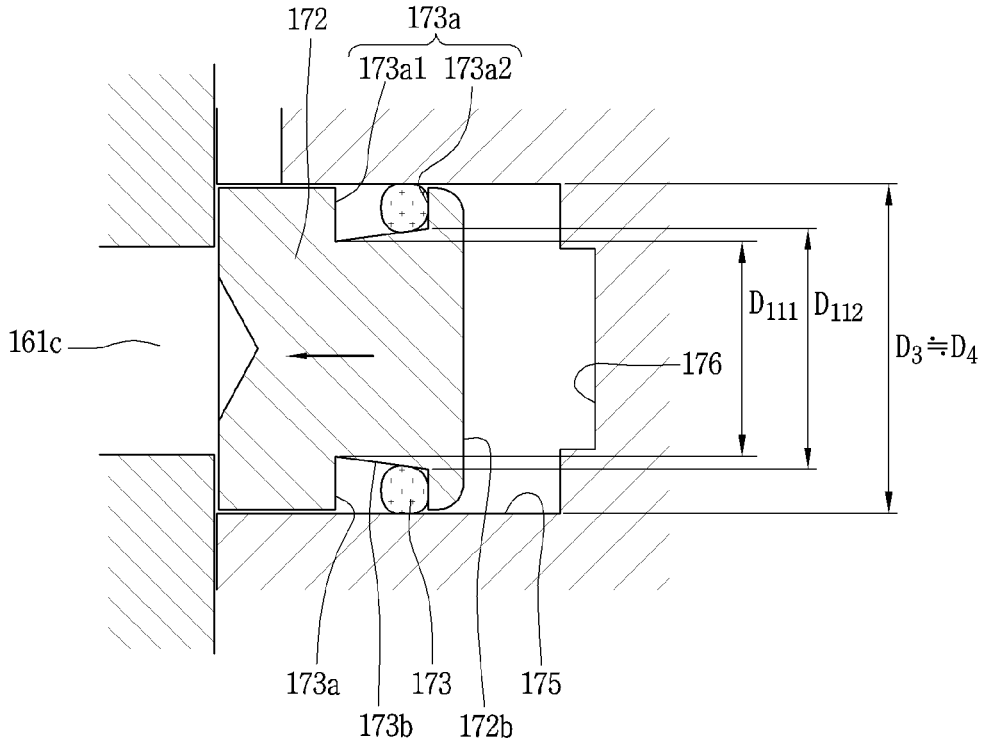
FIG. 12A is a sectional view showing the power operation and the saving operation for seal receiving grooves in the first valve assembly according to an embodiment of the present disclosure.
Figure 12B:
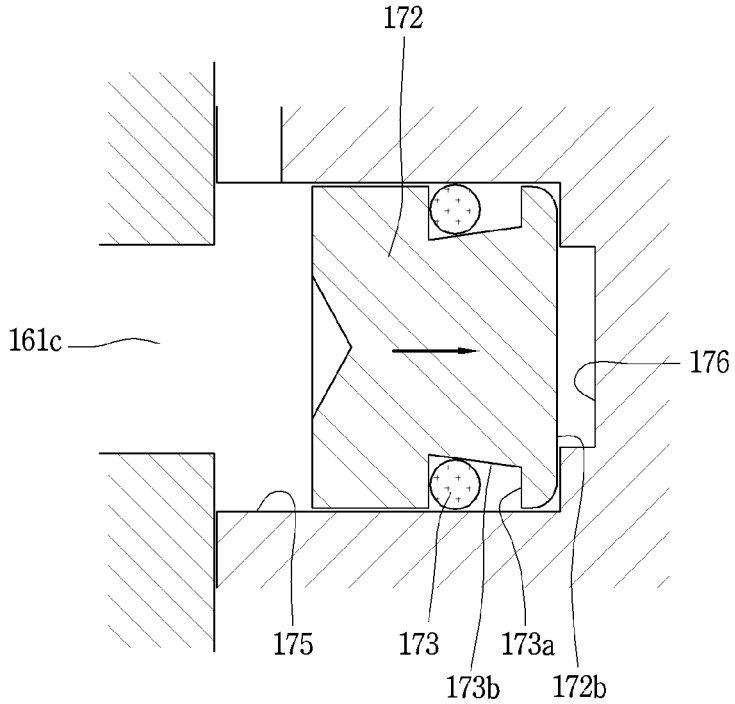
FIG. 12B is a sectional view showing the power operation and the saving operation for seal receiving grooves in the first valve assembly according to an embodiment of the present disclosure.

On the contrary, as shown in FIGS. 12A and 12B, when seal member 173 according to the present embodiment is coupled to the outer peripheral surface of the check valve 172, as in the above-described embodiment of FIGS. 11A and 11B, the inner diameter D3 and outer diameter D4 of valve receiving portion 175 may be significantly constant along the longitudinal direction, respectively, and the inner diameter of the main surface of seal receiving groove 173*a* may be variable along the longitudinal direction.

For example, the inner diameter D111 of seal receiving groove 173*a* that is close to discharge hole 161*c* may be smaller than the inner diameter D112 that is distant from discharge hole 161*c*. Accordingly, an inclined surface 173*b* is formed on the inner peripheral surface of seal receiving groove 173*a*, so that the depth of seal receiving groove 173*a* may gradually decrease in a direction toward differential pressure space portion 176 from front surface 173*a*1 to rear surface 173*a*2. Thus, the minimum diameter of seal receiving groove 173*a* may be less than or equal to the inner diameter of seal member 173, and the maximum diameter of seal receiving groove 173*a* may be larger than the inner diameter of seal member 173.

As described above, even when inclined surface 173*b* is formed on the inner peripheral surface of seal receiving groove 173*a* provided in the outer peripheral surface of check valve 172, the general operational effect is similar to that of the above-described embodiment of FIGS. 11A and 11B. That is, in the power operation of FIG. 12A, the sealing force between valve receiving portion 175 and seal member 173 may be increased to improve energy efficiency, and in the saving operation of FIG. 12B, the frictional force between valve receiving portion 175 and seal member 173 may be decreased to improve energy saving effects.

On the other hand, a still further embodiment of the first valve assembly in the scroll compressor according to the present invention will now be described.

Figure 13A:
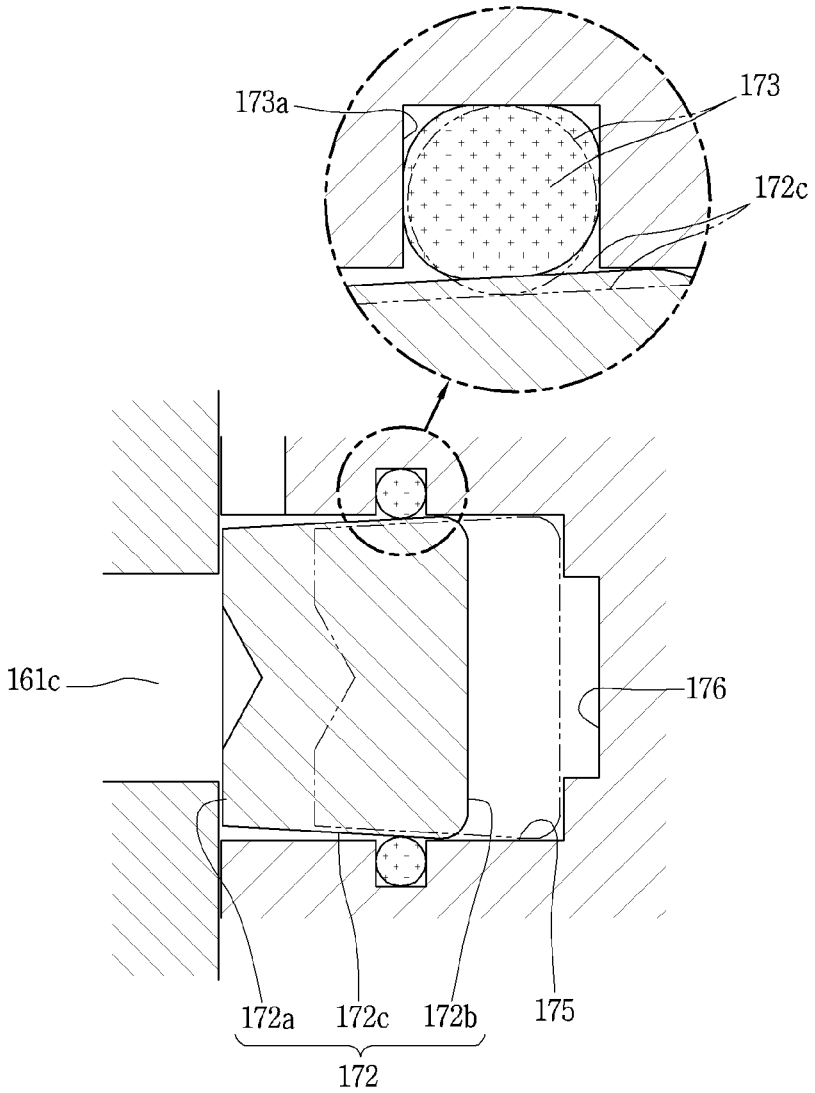
FIG. 13A is a sectional view showing an embodiment based on fixed positions of the seal member according to an embodiment of the present disclosure.
Figure 13B:
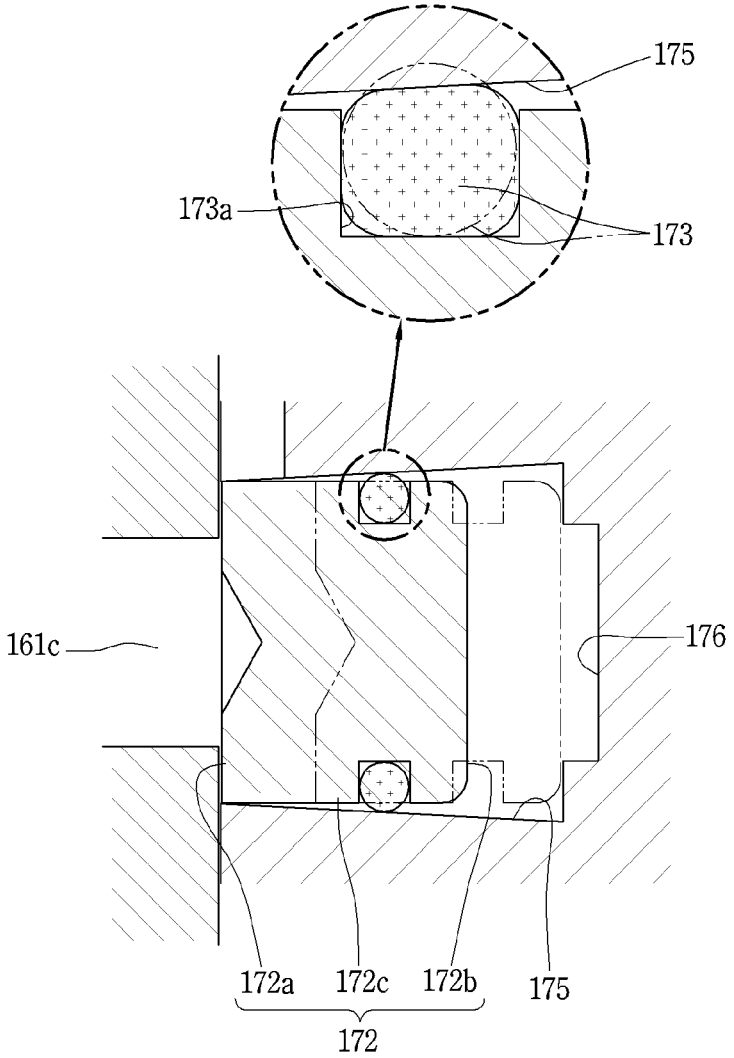
FIG. 13B is a sectional view showing an embodiment based on fixed positions of the seal member according to an embodiment of the present disclosure.

That is, in the above-described embodiments, the seal receiving groove may be formed longer than the seal member so that the seal member can move within the seal receiving groove, but in the present embodiment, the seal member may be inserted into and fixed to the seal receiving groove. Also in this case, the minimum diameter of the inclined surface corresponding to the seal member may be less than or equal to the outer diameter of the seal member, and the maximum diameter of the inclined surface may be larger than the outer diameter of the seal member. FIGS. 13A and 13B are sectional views showing embodiments based on fixed positions of the seal member according to the present embodiment.

In the embodiment of FIG. 13A, seal receiving groove 173*a* is formed in the inner peripheral surface of valve receiving portion 175. In this case, the inner diameters of both ends of valve receiving portion 175 may be formed having the same cylindrical shape, but the outer diameter of check valve 172 on the side of opening/closing surface 172*a* may be smaller than the outer diameter on the side of back pressure surface 172*b*. Therefore, in the power operation, when check valve 172 moves in the closing direction, the distance between seal member 173 and check valve 172 may be decreased so as to improve the sealing force, whereas, in the saving operation, when check valve 172 moves in the opening direction, the distance between seal member 173 and check valve 172 may be increased so as to reduce the frictional force.

In the embodiment of FIG. 13B, the seal receiving groove 173*a* is formed in the outer peripheral surface of the check valve, respectively, an inclined surface being formed on valve receiving portion 175, respectively. Also in this case, as in the above embodiment of FIG. 13A, in the power operation, when check valve 172 moves in the closing direction, the distance between seal member 173 and check valve 172 may be decreased so as to improve the sealing force, whereas, in the saving operation, when check valve 172 moves in the opening direction, the distance between seal member 173 and check valve 172 may be increased so as to reduce the frictional force.

As described above, when seal receiving groove 173*a* is formed in a semicircular sectional shape and seal member 173 is inserted into and fixed to seal receiving groove 173*a*, seal receiving groove 173*a* can be more easily processed, and the insertion state of seal member 173 may be maintained to prevent leakage.

On the other hand, a still further embodiment of the scroll compressor according to the present invention will now be described.

Figure 14:
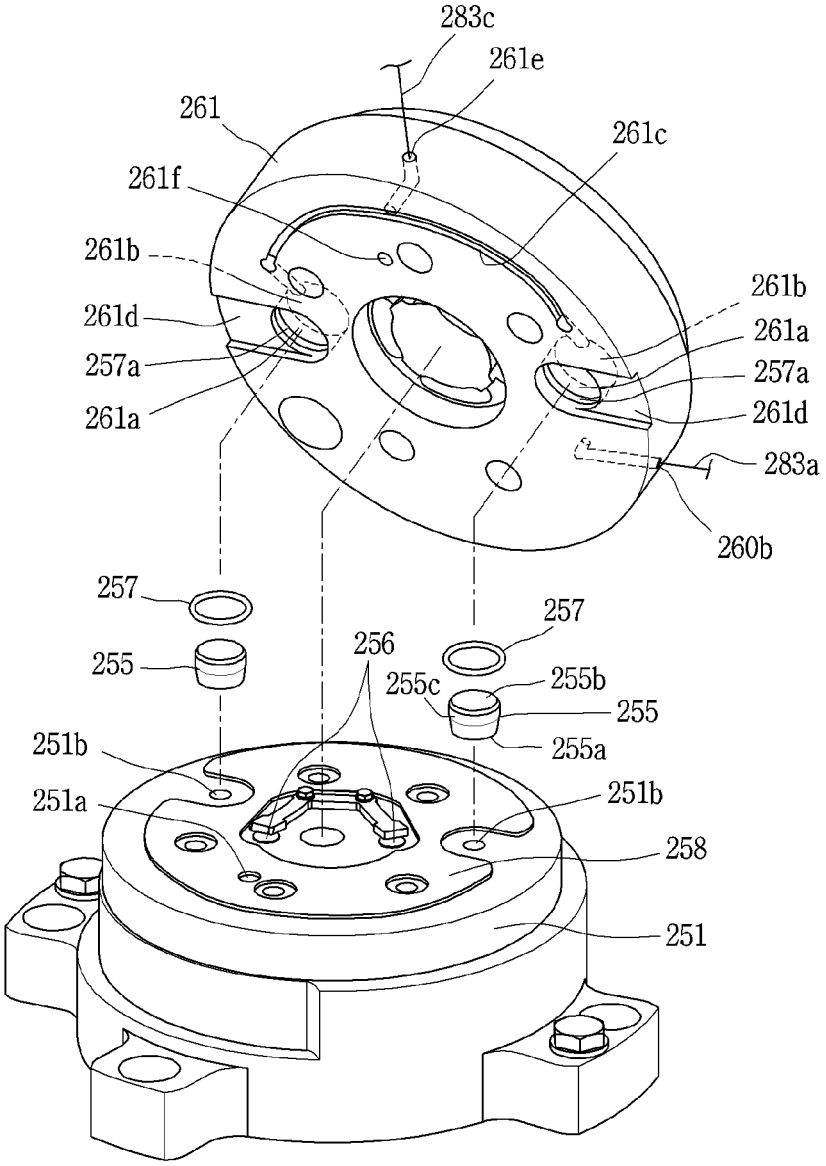
FIG. 14 is an exploded perspective view showing another embodiment of the capacity variable device in the scroll compressor according to an embodiment of the present disclosure.
Figure 15:
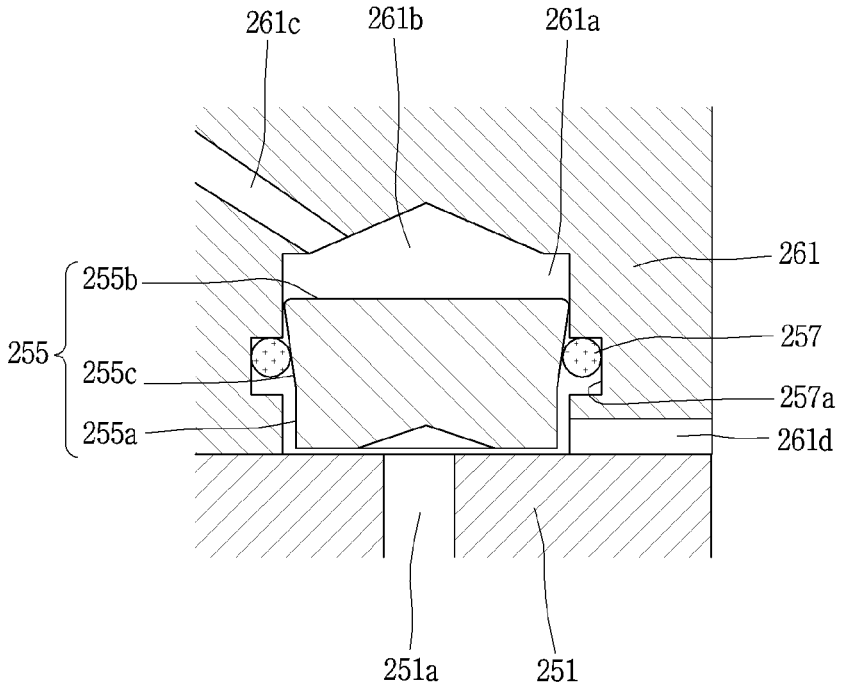
FIG. 15 is an enlarged sectional view showing the check valve of FIG. 14.
Figure 16A:
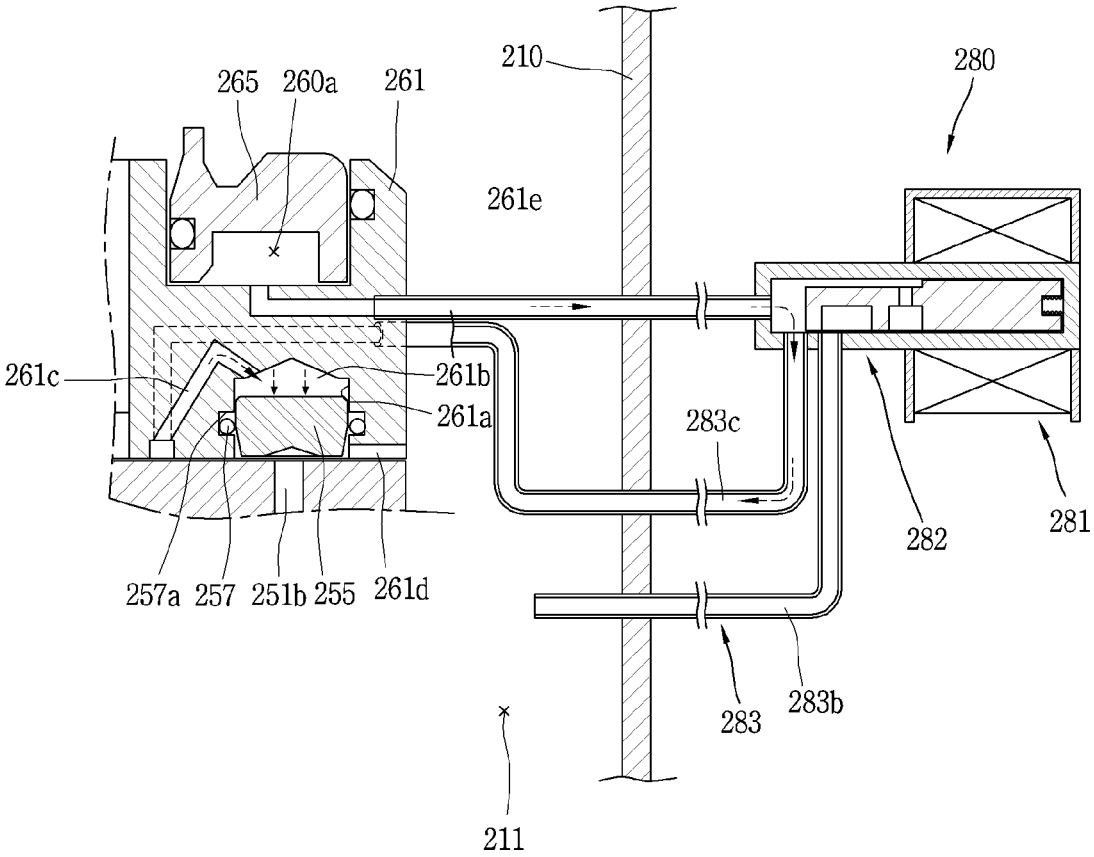
FIG. 16A is a sectional view showing the power operation in the scroll compressor having the capacity variable device according to an embodiment of the present disclosure.
Figure 16B:
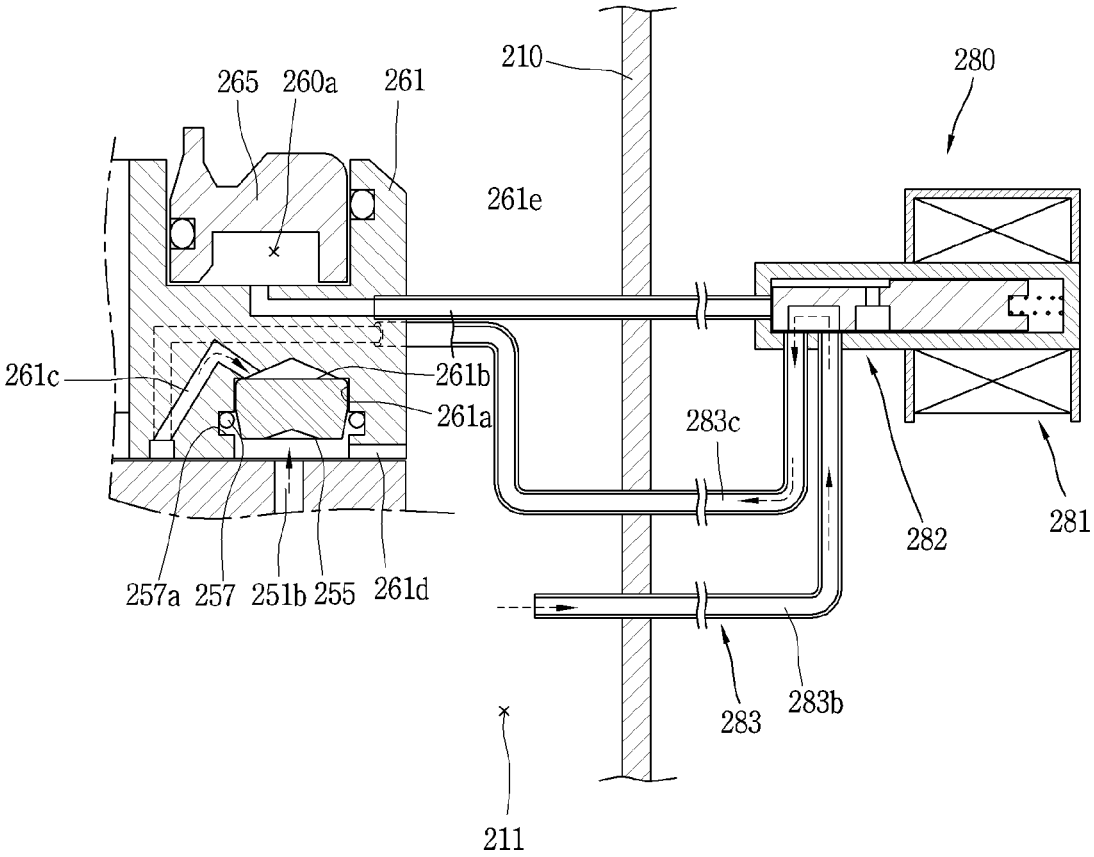
FIG. 16B is a sectional view showing the saving operation in the scroll compressor having the capacity variable device according to an embodiment of the present disclosure.

That is, in the above-described embodiments, the first valve assembly is provided outside the second scroll or the back pressure chamber assembly, but the same applies to the present embodiment in which the first valve assembly is provided inside the back pressure chamber assembly. FIG. 14 is an exploded perspective view showing another embodiment of the capacity variable device in the scroll compressor according to the present invention,. FIG. 15 is an enlarged sectional view showing the check valve of FIG. 14. FIGS. 16A and 16B are sectional views showing the power operation and the saving operation in the scroll compressor having the capacity variable device according to the present embodiment, respectively.

In the above-described embodiments, the bypass valve and the first valve assembly are combined into the check valve; however, in the present embodiment, the check valve is configured to be controlled as a valve assembly corresponding to the second valve assembly of the above-described embodiments.

As shown in FIGS. 14 and 15, an intermediate pressure hole 260*b* which is formed from the bottom surface of a back pressure chamber 260*a* (see FIGS. 16A and 16B) to an outer peripheral surface of a back pressure plate 261 in a penetrating manner and which allows some of the refrigerant in the back pressure chamber 260*a* to be guided to a first connection pipe 283*a* (discussed in more detail below) is formed in back pressure plate 261 of the present embodiment.

In addition, a plurality of valve receiving portions 261*a* into which a plurality of check valves 255 composed of piston valves are slidably inserted are formed in the bottom surface of the back pressure plate 261 to be axially depressed by a predetermined depth, and in each case, a differential pressure space portion 261*b* is formed at one side of each valve receiving portion in the axial direction, with check valve 255 therebetween, on the side of the rear surface of check valve 255.

Differential pressure space portion 261*b* is formed on both sides with a phase difference of 180° together with valve receiving portion 261*a*, respectively, differential pressure space portions 261*b* being in communication with each other by a connection passage grooves 261*c* formed in the bottom surface of back pressure plate 261. In this case, as shown in FIG. 14, both ends of connection passage grooves 261*c* are inclined toward the respective differential pressure space portions 261*b*.

Also, a discharge groove 261*d* which allows refrigerant discharged from the intermediate pressure chamber through each of the first bypass holes 251*b* when each check valve 255 is open to be discharged to a low pressure portion 211 of a casing 210 (see FIGS. 16A and 16B) is independently formed in each valve receiving portion 261*a*. The discharge groove 261*d* is formed in the radial direction from the inner peripheral surface of valve receiving portion 261*a* toward the outer peripheral surface of back pressure plate 261.

A differential pressure hole 261*e* is formed in the middle area of connection passage groove 261*c*, for connection to a third connection pipe 283*c* (discussed in more detail below). However, differential pressure hole 261e may be directly connected to either one of differential pressure space portions 261b.

Here, valve receiving portion 261*a* is formed having a constant inner diameter along the longitudinal direction, and a seal receiving groove 257*a* is formed in part of the inner peripheral surface of the valve receiving portion 261*a* so that the seal member 257 can be inserted therein. Seal receiving groove 257*a* may be elongate in the longitudinal direction so that seal member 257 can move therein, such as shown in FIG. 15, or may be formed so that seal member 257 can be inserted and fixed therein, such as shown in FIGS. 13A and 13B. Seal member 257 may be composed of an O-ring having elasticity, such as rubber.

In turn, check valve 255 may be configured such that an outer diameter of an opening/closing surface 255*a* is smaller than an outer diameter of a back pressure surface 255*b*, such as shown in FIG. 5. To this end, an inclined surface 255*c* may be formed on the outer peripheral surface of check valve 255 so that the inner diameter decreases in a direction from back pressure surface 255*b* toward opening/closing surface 255*a*.

Also in this case, the minimum diameter of inclined surface 255*c* may be less than or equal to the outer diameter of seal member 257, and the maximum diameter of inclined surface 255*c* may be larger than the outer diameter of seal member 257.

On the other hand, differential pressure hole 261*e* may be connected to valve assembly 280 (see FIGS. 16A and 16B) through third connection pipe 283*c*. Here, the general structure and operation of valve assembly 280 and first connection pipe 283*a*, second connection pipe 283*b*, and third connection pipe 283*c* connected to the valve assembly 280 are similar to those of the above-described embodiments, and thus a detailed description thereof will be omitted.

Reference numeral 251*a* denotes a scroll-side back pressure hole, 256 denotes a bypass valve for opening/closing the second bypass hole, 261*f* denotes a plate-side back pressure hole, 265 denotes a floating plate, 281 denotes a power supply portion, 282 denotes a valve portion, 283 denotes a connection portion.

First, as shown in FIG. 16A, when the compressor is operated in the power mode, the intermediate pressure refrigerant is introduced into differential pressure hole 261*e* through first connection pipe 283*a* and third connection pipe 283*c* by valve assembly 280, and the refrigerant flowing into differential pressure hole 261*e* is introduced into both differential pressure space portions 261*b* through a connection passage groove 261*c*.

Then, the pressure in differential pressure space portions 261*b* pressurizes back pressure surface 255*b* of check valve 255 while forming an intermediate pressure. Here, since the transverse sectional area of differential pressure space portions 261*b* is larger than the transverse sectional area of first bypass holes 251*b*, both check valves 255 are pushed by the pressure in differential pressure space portions 261*b*, thus blocking each bypass hole 251*b*. Here, as in the present embodiment, if the depth of seal receiving groove 257*a* is constant in the longitudinal direction and the outer diameter of check valve 255 is inclined to increase toward back pressure surface 255*b*, the closer that check valve 255 approaches first bypass hole 251*b*, the more the squeeze of seal member 257 increases. Then, the closer that check valve 255 approaches first bypass hole 251*b*, the stronger seal member 257 is pressed, so that seal member 257 and check valve 255 can be more closely attached to each other to improve the sealing force.

Such configuration prevents the refrigerant in the compression chamber from leaking to both bypass holes 251*b*, so that the power operation is continuously performed.

To the contrary, when the compressor operates in the saving mode, such as shown in FIG. 16B, the suction pressure refrigerant is introduced into differential pressure hole 261*e* through second connection pipe 283*b* and third connection pipe 283*c* by the valve assembly 280, and the refrigerant flowing into differential pressure hole 261*e* is introduced into both differential pressure space portions 261*b* through connection passage groove 261*c*.

In turn, the pressure in differential pressure space portions 261*b* pressurizes the back pressure surface 255*b* of the check valve 255 while forming a suction pressure. Here, since the pressure in the intermediate compression chamber is greater than the pressure in differential pressure space portions 261b, both check valves 255 are pushed by the pressure in the intermediate compression chamber to be raised, respectively.

Then, as both bypass holes 251*b* are opened and refrigerant is discharged from each intermediate compression chamber to low pressure portion 211 of casing 210 through each discharge groove 261*d*, the compressor performs the saving operation. Here, as in the present embodiment, if the depth of seal receiving groove 257*a* is constant in the longitudinal direction and the outer diameter of check valve 255 is inclined to decrease in a direction toward opening/closing surface 255*a*, as check valve 255 is moved away from first bypass hole 251*b*, the squeeze of seal member 257 contacting check valve 255 gradually decreases. Thus, the check valve 255 moves toward differential pressure space portion 261*b*, and the frictional force between seal member 257 and check valve 255 gradually decreases, so that seal member 257 is more rapidly opened.

The operational effect of the scroll compressor having the capacity variable device according to the present embodiment as described above is generally similar to those of the above-described embodiments. However, in the present embodiment, unlike the above-described embodiments, both first bypass holes 251*b* independently communicate with low pressure portion 211 of casing 210 through discharge grooves 261*d*, respectively.

Accordingly, in the present embodiment, refrigerant bypassed from the compression chamber through both bypass holes 251*b* is directly discharged to low pressure portion 211 of casing 210 without being merged into one place, which makes it possible to prevent the refrigerant bypassed from the compression chamber from being heated by the refrigerant in back pressure chamber 260*a*.

Meanwhile, in the scroll compressor as described above, the basic structure and thus operational effect of the check valve are similar to those of the check valve of the above-described embodiment in which the bypass valve is provided separately from the check valve. Therefore, a description thereof is replaced with the description of the above embodiment.

In the meantime, in the above-described embodiments, the low pressure scroll compressor is merely an example, it is understood that the same applies to a hermetic compressor in which an internal space of a casing is divided into a low pressure portion which is a suction space and a high pressure portion which is a discharge space.

In the meantime, the foregoing embodiments have illustrated the example in which one seal member is provided, but the present invention may equally be applied even to a case where a plurality of seal members are provided along a reciprocating direction of the valve member.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing with an inner space, the inner space having a low pressure portion and a high pressure portion;

a first scroll provided in the inner space, the first scroll being configured to perform an orbiting motion;

a second scroll that forms a compression chamber with the first scroll, the compression chamber being configured to compress a refrigerant disposed therein;

a bypass passage configured to bypass at least a portion of the refrigerant compressed in the compression chamber to the low pressure portion of the casing;

a valve member to open and close the bypass passage, the valve member being moveable from a first position in which the bypass passage is closed to a second position in which the bypass passage is open;

a valve receiving portion that receives the valve member; and a seal member provided between an outer peripheral surface of the valve member and an inner peripheral surface of the valve receiving portion; and a seal receiving groove provided in at least one of the outer peripheral surface of the valve member and the inner peripheral surface of the valve receiving portion, the seal member being disposed inside the seal receiving groove, wherein at least one of the outer peripheral surface of the valve member, the inner peripheral surface of the valve receiving portion, and an inner peripheral surface of the seal receiving groove has an inclined surface that is inclined in the opening/closing direction of the valve member.

2. The scroll compressor of claim 1, wherein the seal receiving groove is formed in the inner peripheral surface of the valve receiving portion, the inclined surface is formed on the outer peripheral surface of the valve member, and an outer diameter of the inclined surface decreases in a direction toward the bypass passage.

3. The scroll compressor of claim 1, wherein the seal receiving groove and the inclined surface are formed on the outer peripheral surface of the valve member, respectively, and the outer diameter of the inclined surface decreases in a direction toward the bypass passage.

4. The scroll compressor of claim 1, wherein the seal receiving groove is formed on the outer peripheral surface of the valve member, the inclined surface is formed on the inner peripheral surface of the valve receiving portion, and the inner diameter of the inclined surface increases in a direction away from the bypass passage.

5. The scroll compressor of claim 1, wherein the seal receiving groove is formed on the inner peripheral surface of the valve receiving portion, the inclined surface is formed on the inner peripheral surface of the seal receiving groove, and the inner diameter of the inclined surface decreases in a direction toward the bypass passage.

6. The scroll compressor of claim 1, wherein the seal receiving groove is formed on the outer peripheral surface of the valve member, the inclined surface is formed on the inner peripheral surface of the seal receiving groove, and the inner diameter of the inclined surface decreases in a direction toward the bypass passage.

7. The scroll compressor of claim 1, wherein the minimum diameter of the inclined surface is less than or equal to the inner diameter or the outer diameter of the seal member corresponding to the inclined surface, and the maximum diameter of the inclined surface is greater than the inner diameter or the outer diameter of the seal member corresponding to the inclined surface.

8. The scroll compressor of claim 1, wherein the length of the seal receiving groove in the opening/closing direction of the valve member is greater than the diameter of the seal member.

9. A scroll compressor, comprising:

a casing with an inner space, the inner space having a low pressure portion and a high pressure portion;

a first scroll provided in the inner space, the first scroll being configured to perform an orbiting motion;

a second scroll that forms a compression chamber with the first scroll, the compression chamber being configured to compress a refrigerant disposed therein;

a back pressure chamber assembly fixed to the second scroll to form a back pressure chamber;

a bypass passage to bypass at least a portion of the refrigerant compressed in the compression chamber to the low pressure portion of the casing; and a valve assembly comprising:

a first valve assembly to selectively open and close the bypass passage, a second valve assembly to generate a pressure difference in the first valve assembly to control the opening/closing of the first valve assembly, a valve member that is slideable in a valve receiving portion to open and close the bypass passage, a seal member disposed between the valve receiving portion and the outer peripheral surface of the valve member, and a seal receiving groove that receives the seal member, whereby a distance between the seal receiving groove and a sealing surface with which the seal member is in slideable contact with is variable along the moving direction of the valve member.

10. The scroll compressor of claim 9, wherein the distance is such that an amount of thickness reduction of the seal member increases when the valve member is moved to a position in which the bypass passage is closed and the amount of thickness reduction of the seal member decreases when the valve member is moved to a position in which the bypass passage is open.

11. The scroll compressor of claim 10, wherein the valve member is configured such that a sectional area of the opening/closing surface that opens and closes the bypass passage is smaller than a sectional area of a back pressure surface that is opposite to the opening/closing surface.

12. The scroll compressor of claim 10, wherein the valve receiving portion is formed such that a sectional area of a part thereof that is nearest to the bypass passage is smaller than the sectional area of a part of the valve receiving portion that is furthest from the bypass passage.

13. The scroll compressor of claim 10, wherein the valve receiving portion and the valve member each has a constant sectional area along the opening/closing direction of the valve member, and the seal receiving groove has a variable depth along the longitudinal direction of the valve member.

14. The scroll compressor of claim 9, wherein the bypass passage comprises:

a bypass hole formed in the compression chamber, the bypass hole being selectively opened and closed by the first valve assembly;

an intermediate pressure communication groove formed in at least one of the second scroll and the back pressure chamber assembly to be in communication with the bypass hole and receive the bypass valve; and a discharge hole having a first end connected to the intermediate pressure communication groove and a second end formed in the outer peripheral surface of the second scroll or the outer peripheral surface of the back pressure chamber assembly, the discharge hole being opened and closed by the valve member.

15. The scroll compressor of claim 9, wherein the bypass passage comprises:

a bypass hole formed in the compression chamber, the bypass hole being selectively opened and closed by the valve member; and a plurality of discharge grooves, each of the plurality of discharge grooves has a first end selectively communicating with the bypass hole by the valve member and a second end extending to the outer peripheral surface of the second scroll or the back pressure chamber assembly, whereby the bypass hole is in communication with the low pressure portion of the casing.

16. A scroll compressor, comprising:

a casing with an inner space, the inner space having a low pressure portion and a high pressure portion;

a first scroll provided in the inner space, the first scroll being configured to perform an orbiting motion;

a second scroll that forms a compression chamber with the first scroll, the compression chamber being configured to compress a refrigerant disposed therein;

a back pressure chamber assembly fixed to the second scroll to form a back pressure chamber;

a bypass passage to bypass at least a portion of the refrigerant compressed in the compression chamber to the low pressure portion of the casing; and a valve assembly comprising:

a first valve assembly to selectively open and close the bypass passage; and a second valve assembly to generate a pressure difference in the first valve assembly to control the opening/closing operation of the first valve assembly, a valve member that is slideable in the valve receiving portion to open and close the bypass passage, a seal member provided on either a valve receiving portion or the valve member to seal a gap between the valve receiving portion and the valve member, and an inclined surface provided on either the valve receiving portion or the valve member, whereby the minimum diameter of the inclined surface is less than or equal to the inner diameter or the outer diameter of the seal member corresponding to the inclined surface, and the maximum diameter of the inclined surface is greater than the inner diameter or the outer diameter of the seal member corresponding to the inclined surface.

17. The scroll compressor of claim 16, wherein the inclined surface is formed on either an outer peripheral surface of the valve member or an inner peripheral surface of the valve receiving portion.

18. The scroll compressor of claim 16, wherein a seal receiving groove to receive the seal member is formed in either the valve receiving portion or the valve member.

19. The scroll compressor of claim 16, wherein the inclined surface is formed such that an amount of thickness reduction of the seal member increases when the valve member is moved in a direction in which the bypass passage is closed and the amount of thickness reduction of the seal member decreases when the valve member is moved in a direction in which the bypass passage is open.

20. The scroll compressor of claim 16, wherein the seal receiving groove is formed in an overlapping range with the inclined surface.

* * * * *